US011897661B1

(12) United States Patent
Beelen

(10) Patent No.: US 11,897,661 B1
(45) Date of Patent: Feb. 13, 2024

(54) RE-CLOSABLE PAPER-BASED PACKAGE

(71) Applicant: The Procter & Gamble Company, Cincinnati, OH (US)

(72) Inventor: Laurens Beelen, Mechelen (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/963,709

(22) Filed: Oct. 11, 2022

(51) Int. Cl.

| | |
|---|---|
| ***B65D 33/20*** | (2006.01) |
| ***B65D 75/30*** | (2006.01) |
| ***B65D 75/58*** | (2006.01) |
| ***B65D 30/08*** | (2006.01) |

(52) U.S. Cl.
CPC ..... *B65D 33/20* (2013.01); *B65D 31/02* (2013.01); *B65D 75/30* (2013.01); *B65D 75/5805* (2013.01)

(58) Field of Classification Search
CPC ..... B65D 33/18; B65D 33/20; B65D 33/22; B65D 75/5855
USPC ..... 383/210, 211
See application file for complete search history.

(56) References Cited

U.S. PATENT DOCUMENTS

| | | | | |
|---|---|---|---|---|
| 9,682,802 | B2 * | 6/2017 | McDonough | B65D 33/24 |
| 10,118,737 | B2 | 11/2018 | Septien Rojas et al. | |
| 10,287,063 | B2 | 5/2019 | Septien Rojas et al. | |
| 2005/0031233 | A1 | 2/2005 | Varanese et al. | |
| 2008/0105679 | A1 | 5/2008 | Ballard | |
| 2016/0122087 | A1 | 5/2016 | Takigawa | |
| 2017/0152085 | A1 | 6/2017 | Septien Rojas et al. | |
| 2017/0190476 | A1 | 7/2017 | Goto et al. | |
| 2018/0057218 | A1 | 3/2018 | O'hagan | |
| 2019/0315524 | A1 | 10/2019 | Huang | |
| 2020/0198842 | A1 | 6/2020 | Hansen | |
| 2020/0198843 | A1 | 6/2020 | Hansen et al. | |
| 2020/0231340 | A1 | 7/2020 | Septien Rojas | |
| 2020/0239195 | A1 | 7/2020 | Hansen et al. | |
| 2020/0255188 | A1 | 8/2020 | Pawelak | |

(Continued)

FOREIGN PATENT DOCUMENTS

| | | | |
|---|---|---|---|
| CN | 112623488 | A | 4/2021 |
| GB | 300470 | A | 11/1928 |

(Continued)

OTHER PUBLICATIONS

17963709_Jul. 17, 2023_DE_102019132879_A1_M (Year: 2021).*

(Continued)

*Primary Examiner* — Jes F Pascua
*Assistant Examiner* — Nina K Attel
(74) *Attorney, Agent, or Firm* — Gary J. Foose

(57) ABSTRACT

A bag that includes a first side sheet and a second side sheet, each of which are more than 80% by weight paper. The first side sheet includes an exteriorly oriented first pivotable flange that is distal to a first folded portion of the first side sheet. The interior facing surface of the panels of the first folded portion are bonded to one another. Optionally, the second side sheet includes an interiorly oriented second pivotable flange that is distal to a second folded portion of the second side sheet. The interior facing surface of the panels of the optional second folded portion are bonded to one another. A repositionable pressure sensitive adhesive is provided that releasably engages the first pivotable flange and the second side sheet or optional second pivotable flange.

20 Claims, 10 Drawing Sheets

(56) References Cited

U.S. PATENT DOCUMENTS

| | | | |
|---|---|---|---|
| 2021/0284394 | A1 | 9/2021 | Hansen et al. |
| 2021/0284396 | A1 | 9/2021 | Plourde et al. |
| 2022/0324617 | A1 | 10/2022 | Beelen |

FOREIGN PATENT DOCUMENTS

| | | | |
|---|---|---|---|
| GB | 916266 | A | 1/1963 |
| GB | 1354481 | A | 6/1974 |
| JP | 2000118536 | A | 4/2000 |
| WO | 9850279 | A2 | 11/1998 |
| WO | 2014045777 | A1 | 3/2014 |
| WO | 2015031811 | A1 | 3/2015 |
| WO | 2016202865 | A1 | 12/2016 |
| WO | 2019148454 | A1 | 8/2019 |
| WO | 2022087038 | A1 | 4/2022 |

OTHER PUBLICATIONS

All Office Actions; U.S. Appl. No. 17/719,507.
Extended EP Search Report and Search Opinion for 23170283.8 dated Aug. 2, 2023, 10 pages.
PCT Search Report and Written Opinion for PCT/US2023/018904 dated Aug. 2, 2023, 16 pages.

* cited by examiner

RE-CLOSABLE PAPER-BASED PACKAGE

FIELD OF THE INVENTION

Re-closable paper-based package.

BACKGROUND OF THE INVENTION

Re-closable recyclable packages are desirable to consumers. Rigid recyclable packages made of paperboard, corrugated paperboard, glass, and plastic can meet such a desire. For certain types of products, rigid packages may not be desirable for a multitude of reasons.

Many products are packaged in flexible plastic film bags. Flexible plastic film bags may be lightweight, durable, and inexpensive. Plastic film bags can be provided with a mechanism to reclose the bag after first opening the package. For example, dry food bags are commonly re-closeable with a twist tie or plastic slotted clip. Some products, including water soluble unit dose laundry and dish products, are sold in flexible plastic film bags that include an interlocking closure. Common interlocking closure mechanisms include slide-seals in which a sliding mechanism includes a plow to push apart a tongue-in-groove connection when opening and a guide to reclose the connection. Press seal interlocking closure mechanisms such as VELCRO, a tongue-in-groove connection, interlocking knobs, and the like that than can be directly opened and closed by the user's fingers are also common. Like the flexible plastic film bags, the closure mechanisms are commonly constructed of plastic materials since plastic materials have the requisite combination of flexibility to allow interlocking mechanisms to interlock, stiffness to resist unintentional opening, and durability.

Some consumers may have inconvenient access to a deposit point of the recycling stream for plastic film bags. With this limitation in mind, there is a continued unaddressed need for re-closable bags that consumers can conveniently deposit into a recycling stream.

SUMMARY OF THE INVENTION

A bag comprising: a first side sheet having a pair of first side sheet transverse edges and a first side sheet interior facing surface, wherein said first side sheet comprises an exteriorly oriented first pivotable flange that is distal to a first folded portion of said first side sheet and said first folded portion comprises a plurality of first panels in which said first side sheet interior facing surface of said first panels are bonded to one another; a second side sheet opposite said first side sheet and having a second side sheet interior facing surface facing said first side sheet interior facing surface, wherein said second side sheet is connected with said first side sheet across a bottom of said bag and has a pair of second side sheet transverse edges, wherein each said first side sheet transverse edge is joined to an opposing second side sheet transverse edge, wherein said second side sheet comprises an interiorly oriented second pivotable flange that is distal to a second folded portion of said second side sheet and said second folded portion comprises a plurality of second panels in which said second side sheet interior facing surface of said second panels are bonded to one another; and a repositionable pressure sensitive adhesive that releasably engages said first pivotable flange and said second pivotable flange. The first side sheet and said second side sheet are each more than 80% by weight paper.

A bag comprising: a first side sheet having a pair of first side sheet transverse edges and a first side sheet interior facing surface, wherein said first side sheet comprises an exteriorly oriented first pivotable flange that is distal to a first folded portion of said first side sheet and said first folded portion comprises a plurality of first panels in which said first side sheet interior facing surface of said first panels are bonded to one another; a second side sheet opposite said first side sheet and having a second side sheet interior facing surface facing said first side sheet interior facing surface, wherein said second side sheet is connected with said first side sheet across a bottom of said bag and has a pair of second side sheet transverse edges, wherein each said first side sheet transverse edge is joined to an opposing second side sheet transverse edge; and a repositionable pressure sensitive adhesive that releasably engages said first pivotable flange and said second side sheet. The first side sheet and said second side sheet are each more than 80% by weight paper.

DETAILED DESCRIPTION OF THE INVENTION

The term "joined to" encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined to" encompasses configurations in which an element is secured to another element at selected locations, as well as configurations in which an element is completely secured to another element across the entire surface of one of the elements. The term "joined to" includes any known manner in which elements can be secured.

The recycling stream for paper products is readily available to many consumers. Hence, paper packaging may be conveniently deposited into the recycling stream by consumers. Many consumers view bags as a preferred package for consumer goods. Bags have many advantages over rigid packages including, but not limited to, being lightweight, durable, and inexpensive. In particular, paper based bags present an opportunity for meeting an unmet consumer desire for being able to deposit paper bags in the paper recycling stream.

For many products that are packaged in bags, consumers and manufacturers desire to have a closure mechanism that can be easily opened and securely reclosed. This can be especially true for bags that contain multiple single-use products that the consumer occasionally retrieves for use and the remaining single-use products are stored in the bag for use in the future.

Figure 1:
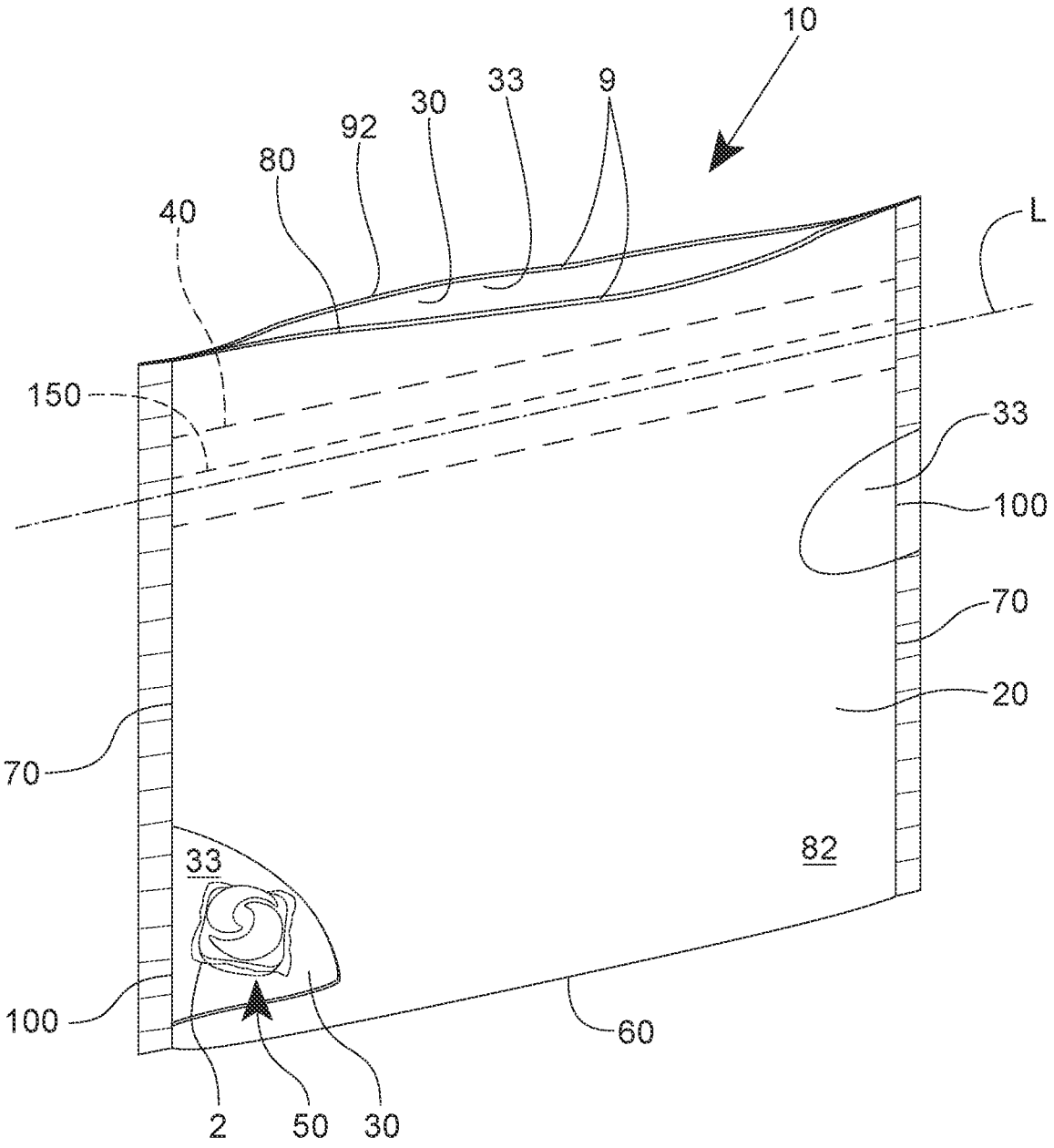
FIG. 1 is a perspective view of a bag.

A bag 10 is shown in FIG. 1. The bag 10 can comprise a first side sheet 20 and a second side sheet 30. The second side sheet 30 can be connected with the first side sheet 20 across the bottom 60 of the bag 10. The first side sheet 20 and second side sheet 30 can be separate pieces that are joined to one another at the bottom 60 of the bag 10. Optionally, the first side sheet 20 and the second side sheet 30 can be continuous. For example, the first side sheet 20 and the second side sheet 30 can be formed from a single substrate that is folded at the bottom 60. The interior space 50 can contain a plurality of articles 2. The first side sheet 20 can be continuous with the second side sheet 30 across the bottom 60 of the bag 10. The first side sheet 20 and the second side sheet 30 can comprise paper. The first side sheet 20 and the second side sheet 30 can be a paper based substrate or substrates. The first side sheet 20 and the second side sheet 30 can be a single side coated paper based substrate or substrates. Optionally, the first side sheet 20 and the second side sheet 30 can have a thermoplastic film forming the first side sheet interior facing surface 23 and the second side sheet interior facing surface 33. The bag 10 can have a pair of top edges 9 opposite the bottom 60.

The first side sheet 20 can have a pair of first side sheet transverse edges 70 and a first side sheet interior facing surface. The second side sheet 30 can be opposite the first side sheet 20 and can have a second side sheet interior facing surface 33 facing the first side sheet interior facing surface. The second side sheet 30 can have a pair of second side sheet transverse edges 100. Each of the first side sheet transverse edges 70 can be joined to an opposing second side sheet transverse edge 100. The repositionable pressure sensitive adhesive 150 can be opposite the bottom 60 and extend along a longitudinal axis L.

The first side sheet 20 can have a first side sheet exterior facing surface 82 opposite the first side sheet interior facing surface. Likewise, the second side sheet can have a second side sheet exterior facing surface 92 opposite the second side sheet interior facing surface 33.

The bottom 60 of the bag 10 can be configured in a variety of ways. For instance the bottom 60 can be formed by joining the first side sheet 20 and the second side sheet 30 at the bottom 60. The first side sheet 20 and second side sheet 30 can be formed from a single continuous substrate that is folded twice or bent at the bottom 60 to form a flat bottom 60 of the bag 10. Gussets and seals can be employed in one or both of the first side sheet 20 and second side sheet 30 to provide for the desired shape of the bottom 60 of the bag 10. Moreover, gussets and seals can be employed at the transverse edges of the first side sheet 20 and second side sheet 30 proximal the bottom 60 to provide for the desired shape of the bottom 60 of the bag 10. Gussets and seals can likewise be employed at other locations along the transverse edges of the first side sheet 20 and second side sheet 30 to provide for the desired shape of the transverse edges of the bag 10 when the bag 10 is filled.

The closure 40 of the bag is opposite the bottom 60 and extends along the longitudinal axis L. The closure 40 comprises the first pivotable flange, optionally the second pivotable flange, and the repositionable pressure sensitive adhesive 150.

Figure 2:
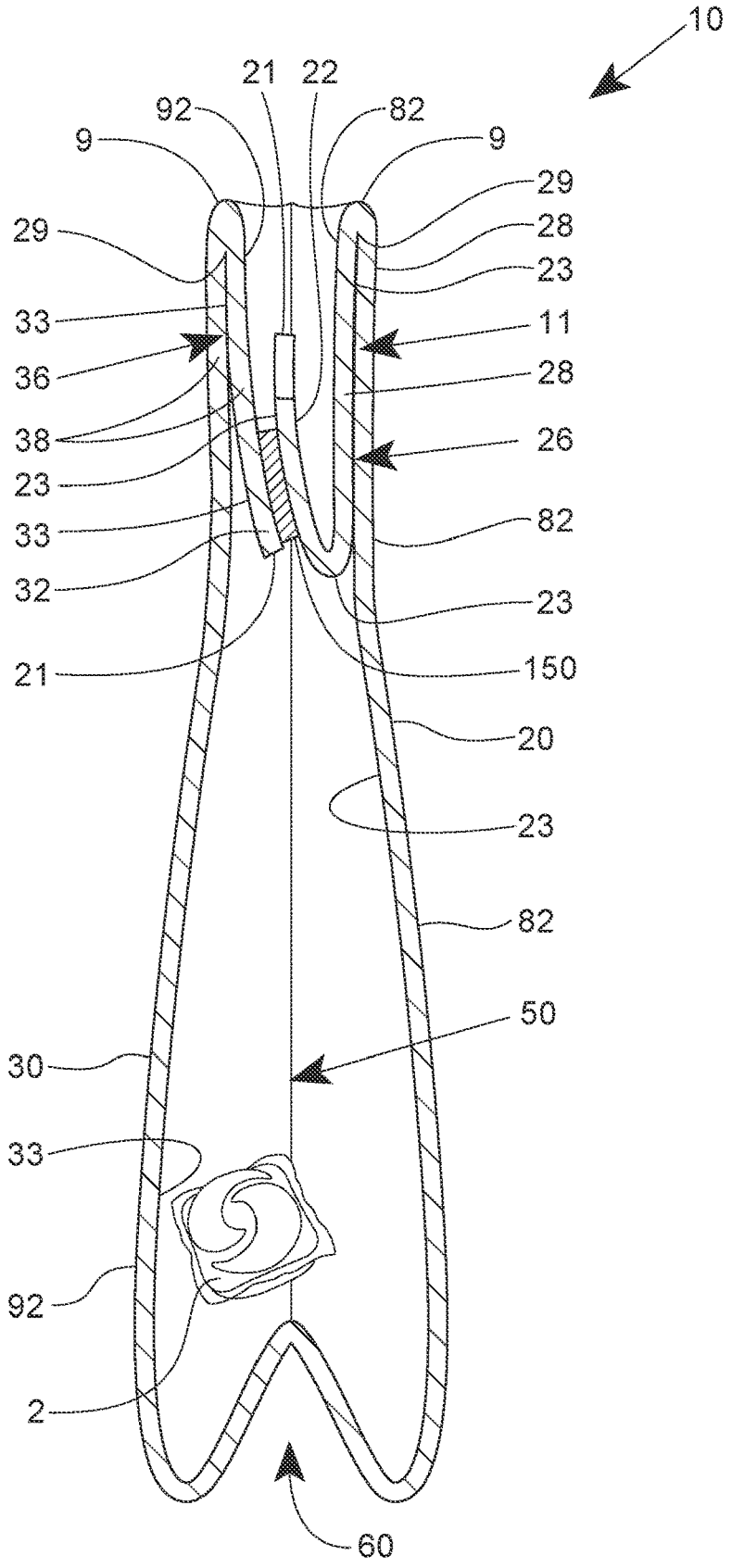
FIG. 2 is a cross section of a bag.

The first side sheet 20 can comprise an exteriorly oriented first pivotable flange 22 that is distal to a first folded portion 26 of the first side sheet 20 comprising a plurality of first panels 28 in which the first side sheet interior facing surface 23 of the first panels 28 are bonded to one another (FIG. 2). The first folded portion 26 of the first side sheet 20 can be a z-fold 11. A single fold of the first side sheet 20 back towards the interior space 50 yields two complete first panels 28 divided by an outer fold line 29, the outer fold line 29 being oriented away from the interior space 50. The vertex of the outer fold line 29 or outer fold lines 29 can point away from the bottom 60. As described herein, the outermost first panel 28 forms part of the exterior of the bag. The first pivotable flange 22, is exteriorly oriented in the sense that first pivotable flange 22 points away from the bottom 60 and the interior space 50. That is, the terminal end 21 of the first pivotable flange 22 is oriented away from the interior space 50.

To hold the first folded portion 26 in a folded configuration, the first side sheet interior facing surface 23 of the first panels 28 can be bonded to one another. The first side sheet interior facing surface 23 of the first side sheet 20 is the surface of the first side sheet 20 oriented towards the interior space 50 and extensions of that surface through the first folded portion. Thus, it is to be understood that part or parts of the first side sheet interior facing surface 23 extend into and through the first folded portion as the interior facing surface 23 that is open to the interior space 50 is traced through the first folded portion 26 all the way to the first pivotable flange 22. For example, in FIG. 2, the first side sheet interior facing surface 23 present in the interior of the fold of the first folded portion 26 and first pivotable flange 22.

The second side sheet 30 can comprise an interiorly oriented second pivotable flange 32 that is distal to a second folded portion 36 of the second side sheet 30 comprising a plurality of second panels 38 in which the second side sheet interior facing surface 33 of the second panels 38 are bonded to one another. The second folded portion 36 of the second side sheet 30 can be a single fold. A single fold in the second side sheet 30 yields two second panels 38 divided by an outer fold line 29. As described herein, the outermost second panel 38 forms part of the exterior of the bag 10. The second pivotable flange 32 is interiorly oriented in the sense that the second pivotable flange 32 points towards the bottom 60. That is, the terminal end 21 of the second pivotable flange 32 is oriented towards the interior space 50.

The bag 10 can comprise a repositionable pressure sensitive adhesive 150 that releasably engages the first pivotable flange 22 and the second pivotable flange 32. The pressure sensitive adhesive 150 can be opposite the bottom 60 and extend along the longitudinal axis L. The longitudinal axis L can extend from one first side sheet transverse edge 70 and second side sheet transverse edge 100 to the opposing first side sheet transverse edge 70 and second side sheet transverse edge 100. The repositionable pressure sensitive adhesive 150 releasably connects parts of the first side sheet 20 and the second side sheet 30. Together, the bottom 60, part of the first side sheet 20, and part of the closure 40 define the interior space 50. The repositionable pressure sensitive adhesive 150 can be on a surface selected from the group of the first pivotable flange 22, the second pivotable flange 32, and combinations thereof.

A bag 10 that includes an exteriorly oriented first pivotable flange 22 and an interiorly oriented second pivotable flange 32 can be suitable for retaining the contents of the bag 10 when the bag 10 is inverted. When the bag 10 is in an upright position with the bottom 60 oriented downwardly, the first pivotable flange 22 and the second pivotable flange 32 can be generally aligned vertically, notwithstanding minor variations in orientation arising from bulging and wrinkling of the bag 10 and the accompanying deformations along the first folded portion 26 and second folded portion 36.

Figure 3:
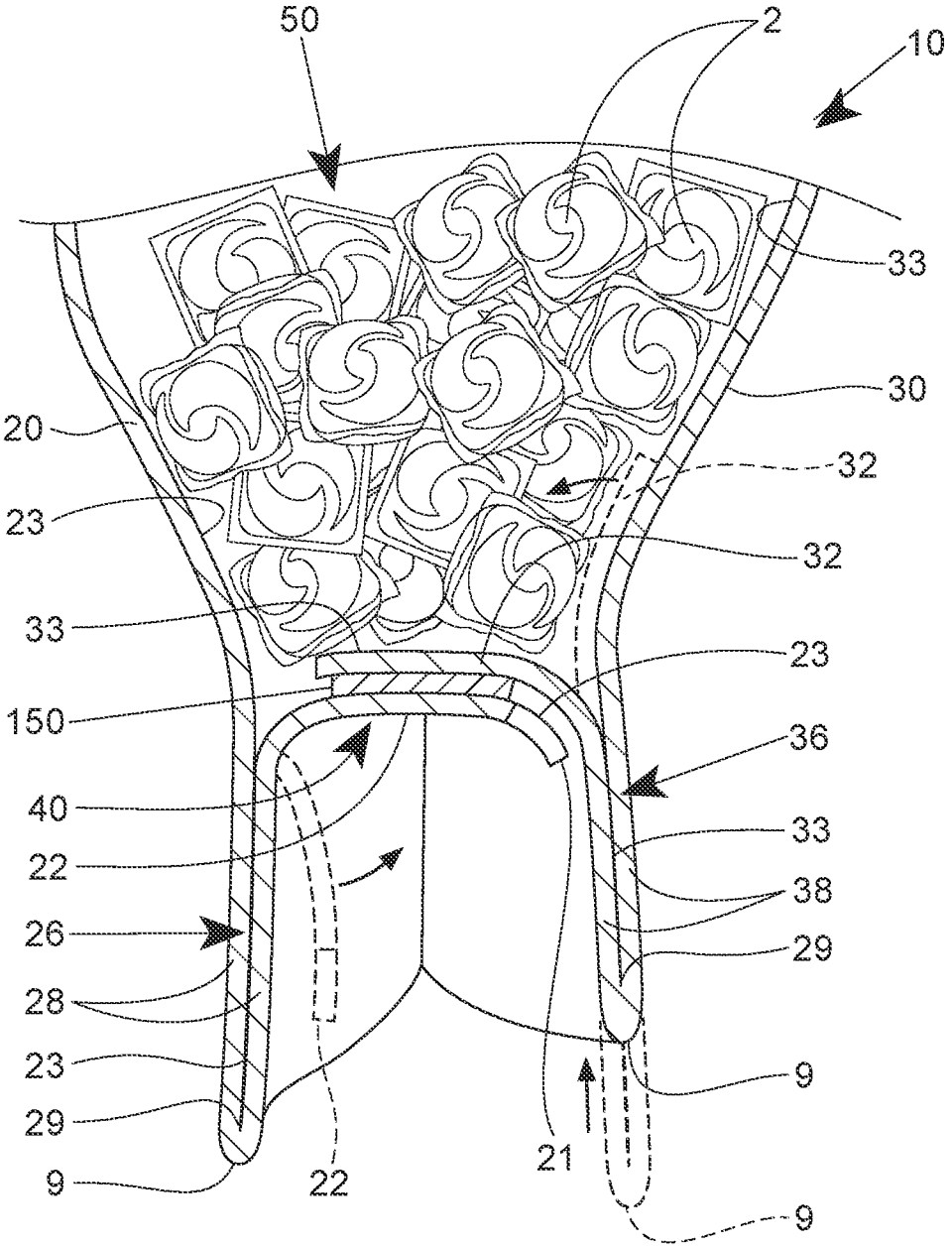
FIG. 3 is a cross section of part of a bag containing articles that is turned upside down.

When the bag 10 is inverted, the contents of the bag 10 may rest on the second pivotable flange 32 and the lateral pressure of the contents of the bag 10 will tend to push apart the first side sheet 20 and the second side sheet 30 (FIG. 3). The first pivotable flange 22 and the second pivotable flange 32 will tend to counter rotate relative to the first folded portion 26 and the second folded portion 36, respectively, and connect the first folded portion 26 and the second folded portion 36 in a somewhat straight line or a sagged line. That is, the first pivotable flange 22 can pivot about the location from which the first pivotable flange 22 extends from a part of the first folded portion 26 in which the first side sheet interior facing surface 23 of the first panels 28 are bonded to one another. And the second pivotable flange 32 can pivot about the location from which the second pivotable flange 32 extends from part of the second folded portion 36 in which second side sheet interior facing surface 33 of the second panels 38 are bonded to one another. FIG. 3 illustrates the movement of the components of the closure 40 as the flanges pivot as described above.

When the bag 10 is inverted, the bag 10 can remain closed by the connection between the first pivotable flange 22 and the second pivotable flange 32 that is provided by the repositionable pressure sensitive adhesive 150. The shear strength of the repositionable pressure sensitive adhesive 150 and the shear strength of the connection between the repositionable pressure sensitive adhesive 150 and the surface, or opposing repositionable pressure sensitive adhesive 150, to which the repositionable pressure sensitive adhesive 150 is releasably engaged resist separation of the first pivotable flange 22 and the second pivotable flange 32 by shearing movement of the parts relative to one another.

In general, repositionable pressure sensitive adhesive 150 tends to be stronger when a pure normal force or pure shear force is applied as compared to a peeling force. Peeling forces are applied locally at the peeling interface and hence tend to generate locally high normal and or shear stresses at the peeling interface. Pure normal force and pure shear force are applied over a larger area than peeling forces and hence tend to generate comparatively lower normal and shear stresses. In a peeling mode of separation, most if not all of the force is applied at the peeling interface or proximal thereto, which has a limited area or volume over or through which the force may be conveyed as stress, thereby creating locally high normal and or shear stresses.

When a bag 10 that includes a closure 40 that comprises a first pivotable flange 22 and a second pivotable flange 32 is in the upright position, as shown in FIG. 1, the user can grip the first pivotable flange 22 to apply a peeling force at the interface of the first pivotable flange 22 and the second pivotable flange 32. The peel strength of the repositionable pressure sensitive adhesive 150 governs the ease or difficulty that the user experiences when peeling the first pivotable flange 22 and the second pivotable flange 32 away from one another. The closure 40 can comprise the first pivotable flange 22, second pivotable flange 32, and the repositionable pressure sensitive adhesive 150. When the bag 10 is turned upside down or the first folded portion 26 and second folded portion 36 are spread apart, the interior space 50 can be bounded by part of the first side sheet 20, part of the second side sheet 30, and the second pivotable flange 32. The first pivotable flange 22 can be outside the interior space 50. The second pivotable flange can be inside the interior space 50. The contents of the bag 10 may not contact the first pivotable flange 22 when the closure 40 of the bag 10 is closed.

When a closed bag 10 is inverted, as shown in FIG. 3, the repositionable pressure sensitive adhesive 150 connecting the first folded portion 26 and the second folded portion 36 is loaded predominantly in shear. As such, the first pivotable flange 22 and the second pivotable flange 32 are strongly connected to one another and the articles 2 in the interior space 50 of the bag 10 may not spill from the bag 10.

Paper based substrates that may be used to form the bag 10 tend to have low bending strength when configured in an unfolded single layer. The first folded portion 26 and the second folded portion 36 can act as beams that strengthen the bag 10 around the closure 40. Not only is the structure created by folding the paper based substrate thicker, which tends to increase the bending strength in multiple directions as compared to a single thickness of the substrate since the area moment of inertia of the cross section of the structure is increase, the outer fold line 29 is a beam since the fold increases the area moment of inertia as compared to a flat substrate, the term beam being used in it structural sense as it might be used to describe a segment of angle, channel, I-beam, or the like. The beam structure and thickened structure provide for a relatively strong and relatively stiff structure for the bag 10 around the closure 40, as compared to an unfolded substrate.

Figure 4:
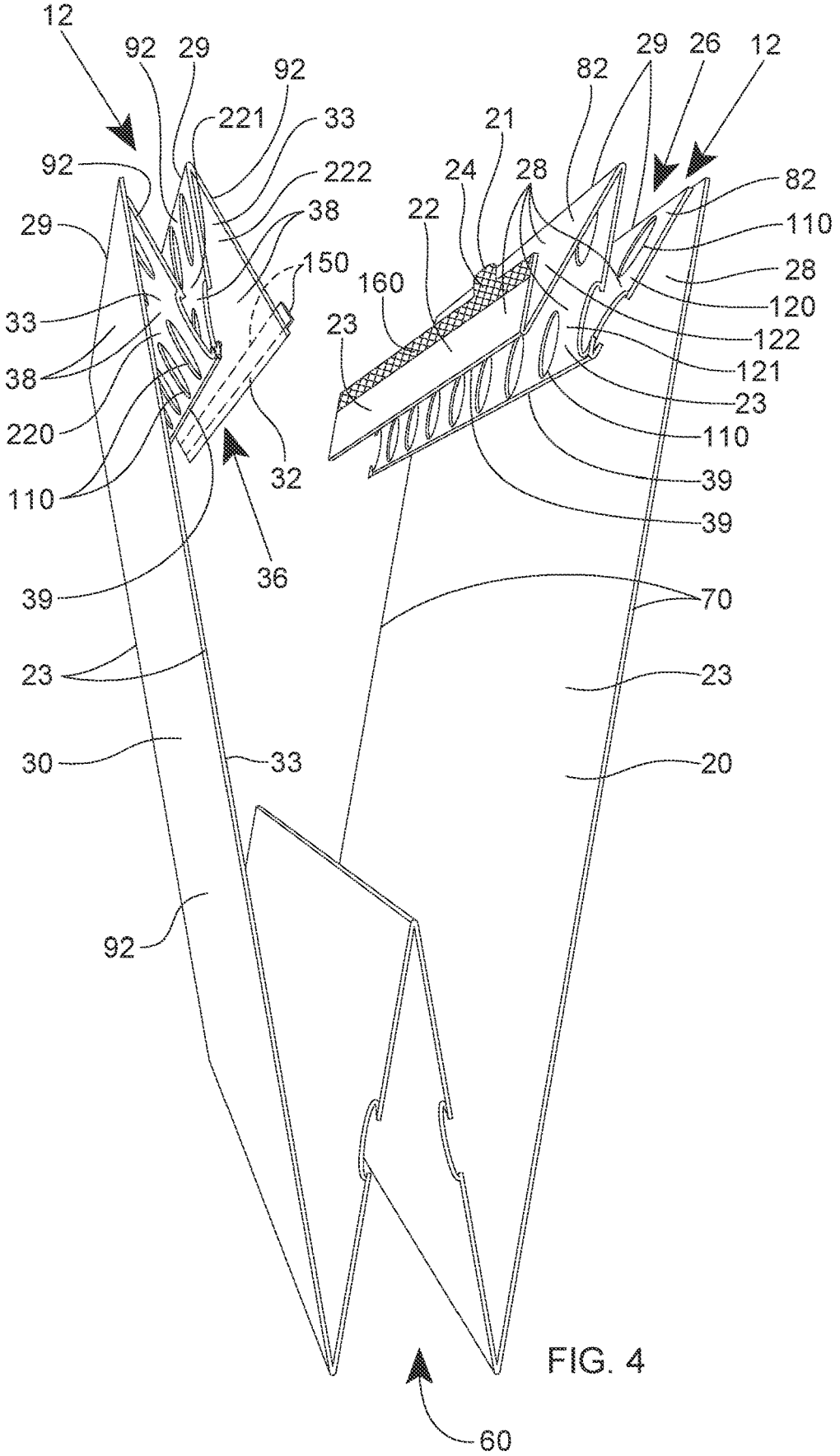
FIG. 4 is a perspective view illustrating formation of a substrate into a structure that can be formed into a bag.

The first folded portion 26 can be an accordion fold 12 (FIG. 4). An accordion fold 12 has four or more panels. The more panels provided in an accordion fold, the thicker the resulting structure and the greater the number of beams, which provide for a relatively strong structure around the closure 40 as compared to an unfolded substrate. In FIG. 4, the first folded portion 26 is shown in a condition in which the first panels 28 are in hingedly open positions. The first side sheet interior facing surface 23 of the first panels 28 can be bonded to one another by way of an adhesive or glue. When the first side sheet interior facing surface 23 of the first side sheet 20 comprises a thermoplastic material, for example a thermoplastic coating or thermoplastic film, the first side sheet interior facing surface 23 of the first panels 28 can be bonded to one another by way of heat sealing. The first side sheet exterior facing surface 82 of the first side sheet 20 forming the first panels 28 can be bonded by way of an adhesive or glue.

Optionally, apertures 110 can be provided in the penultimate first panel 120 away from the first pivotable flange 22. Penultimate means second from last, i.e. next to last. The outermost first panel 28, which forms part of the exterior of the bag 10, is the last first panel 28 away from the first pivotable flange (far right of FIG. 4). The apertures 110 can permit a coating that is the first side sheet interior facing surface 23 of the last first panel 28 away from the first pivotable flange 22 to be bonded to the first side sheet exterior facing surface 82 of the antepenultimate first panel 121 away from the first pivotable flange 22. Antepenultimate means third from last, i.e. next to the next to last. The antepenultimate first panel 121 away from the outermost first panel 28 can be bonded to the outermost first panel 28 through the apertures 110 in the penultimate first panel 120 away from the first pivotable flange 22. For example, a thermoplastic coating forming the first side sheet interior facing surface 23 can be melted and the portions of the antepenultimate first panel 121 away from the first pivotable flange 22 facing the apertures 110 and the first side sheet interior facing surface 23 of the last first panel 28 away from the first pivotable flange 22 can be locally pressed against one another at positions in alignment with the apertures 110. This can be done by way of heat sealing. Once cooled, the solidified thermoplastic coating can bond the first side sheet interior facing surface 23 of the last first panel 28 away from the first pivotable flange 22 to the first side sheet exterior facing surface 82 of the antepenultimate first panel 121 away from the first pivotable flange 22.

The apertures 110 can each have an open area from about 100 $mm^2$ to about 250 $mm^2$, optionally from about 125 $mm^2$ to about 225 $mm^2$, optionally from about 150 $mm^2$ to about 200 $mm^2$, optionally about 175 $mm^2$. The apertures 110 can be circular apertures 110, polygonal apertures 110, oval apertures 110, or any other suitable shape having an open area through which bonding of the interior facing surface of the respective side sheet can be conducted.

The antepenultimate first panel 121 away from the first pivotable flange 22 can comprise apertures 110 aligned with the apertures 110 of the penultimate first panel 120 away from the first pivotable flange 22. Providing apertures 110 in both the antepenultimate first panel 121 away from the first pivotable flange 22 and the penultimate first panel 120 away from the first pivotable flange 22 provides for the first side sheet interior facing surface 23 of the preantepenultimate first panel 122 away from the first pivotable flange 22 to be thermally bonded to the first side sheet interior facing surface 23 of the last first panel 28 away from the first pivotable flange 22 through the apertures 110. Preantepenultimate means fourth from last. With respect to the apertures 110 being aligned, it is meant that the open areas of the aligned apertures 110 at least partially overlap one. That can provide for the ability for the first side sheet interior facing surface 23 of the preantepenultimate first panel 122 away from the first pivotable flange 22 to be thermally bonded to the first side sheet interior facing surface 23 of the last first panel 28 away from the first pivotable flange 22 through the apertures 110.

The second folded portion 36 can be an accordion fold 12. In FIG. 4, the second folded portion 36 is shown in a condition in which the second panels 38 are in hingedly open positions. The second side sheet interior facing surface 33 of the second panels 38 can be bonded to one another by way of an adhesive or glue. When the second side sheet interior facing surface 33 of the second side sheet 30 comprises a thermoplastic material, the second side sheet interior facing surface 33 of the second panels 38 can be bonded to one another by way of heat sealing. The second side sheet exterior facing surface 92 of the second side sheet 30 forming the second panels 38 can be bonded by way of an adhesive or glue.

Optionally, apertures 110 can be provided in the penultimate second panel 220 away from the second pivotable flange 32. The outermost second panel 38, which forms part of the exterior of the bag 10, is the last second panel 38. The apertures 110 can permit a coating that is on the second side sheet interior facing surface 33 to be bonded to the second side sheet exterior facing surface 92 of the antepenultimate second panel 221. The antepenultimate second panel 221 away from the second pivotable flange 32 can be bonded to the last second panel 38 through the apertures 110 in the penultimate second panel 220 away from the second pivotable flange 32. For example, a thermoplastic coating forming the second side sheet interior facing surface 33 can be melted and the portions of the antepenultimate second panel 221 away from the second pivotable flange 32 facing the apertures 110 and the second side sheet interior facing surface 33 of the last second panel 38 away from the second pivotable flange 32 can be locally pressed against one another at positions in alignment with the apertures 110. Once cooled, the solidified thermoplastic coating can bond the second side sheet interior facing surface 33 of the last second panel 38 away from the second pivotable flange 32 to the second side sheet exterior facing surface 92 of the antepenultimate second panel 221 away from the second pivotable flange 32.

The antepenultimate second panel 221 away from the second pivotable flange 32 can comprise apertures 110 aligned with the apertures 110 of the penultimate second panel 220 away from the second pivotable flange 32. Providing apertures 110 in both the antepenultimate second panel 221 and the penultimate second panel 220 provides for the second side sheet interior facing surface 33 of the preantepenultimate second panel 222 to be thermally bonded to the interior facing surface 23 of the last second panel 38 through the apertures 110. Aligned apertures 110 in which the open areas of the apertures 110 overlap one another provide for the pathway through which such bond can be made, like described above with respect the first pivotable flange 22.

The first side sheet interior facing surface 23 and the second side sheet interior facing surface 33 can be coated with a thermoplastic material. The thermoplastic composition coated onto the one or both of the first side sheet interior facing surface 23 and second side sheet interior facing surface 33 can be selected from the group of low density polyethylene, linear low density polyethylene, high density polyethylene, polypropylene, polyacrylamide, linear polyacrylamide, styrene butadiene copolymer, and mixtures thereof.

Optionally, the first side sheet interior facing surface 23 and the second side sheet interior facing surface 33 can be covered with a thermoplastic film. The thermoplastic film can be selected from the group of low density polyethylene, linear low density polyethylene, high density polyethylene, polypropylene, polyacrylamide, linear polyacrylamide, styrene butadiene copolymer, and mixtures thereof.

The first pivotable flange 22 or portion thereof can project exteriorly beyond the pressure sensitive adhesive 150. Arranged as such, the portion of the first pivotable flange 22 that projects exteriorly beyond the pressure sensitive adhesive 150 can provide for a portion of the first pivotable flange 22 that the user of the bag 10 can pinch against the underlying first panels 28 of the first folded portion 26 between the user's thumb and index finger of one hand to peel the first pivotable flange 22 and the second side sheet 30 or second folded portion 36 away from one another by gripping the second side sheet 30 or second folded portion 36 with the other hand. Optionally, the first pivotable flange 22 can be peeled away from the second side sheet 30 or second folded portion 36 by pulling one or the other or both away from the other to peel the first pivotable flange 22 and the second side sheet 30 or second folded portion 36 away from one another. The repositionable pressure sensitive adhesive 150 can resist the separation of the first pivotable flange 22 from the second side sheet 30 or second folded portion 36 so that the bag 10 tends to remain closed unless deliberative effort is applied to open the bag 10. The portion of the first pivotable flange 22 that project exteriorly beyond the pressure sensitive adhesive 150 can be a flexible and or slick material that is challenging to securely pinch between the user's thumb and index finger. That can reduce the potential for opening the bag 10 by just grasping the portion of the first pivotable flange 22 that projects exteriorly beyond the pressure sensitive adhesive 150 and peeling the first pivotable flange 22 away from the second side sheet interior facing surface 33 or second folded portion 36. The portion of the first pivotable flange 22 that projects exteriorly beyond the pressure sensitive adhesive 150 can be coated with slick coating so that such portion cannot be easily grasped or pinched against the underlying first panels 28.

The first pivotable flange 22 can be recessed relative to the outer fold lines 29 of the first folded portion 26 and second folded portion 36 or the outer fold line 29 of the first folded portion 26 and the top edge 9 of the second side sheet 30. The outer fold lines 29 of the first folded portion 26 and the second folded portion 36, or top edge 9 of the second sheet 30, are opposite the bottom 60. The first pivotable flange 22 can be recessed by from about 3 mm to about 70 mm, optionally from about 5 mm to about 50 mm, optionally from about 5 mm to about 30 mm, optionally from about 5 mm to about 20 mm, optionally from about 5 mm to about 15 mm, relative to the outer fold lines 29 or the first folded portion 26.

The first pivotable flange 22 can be recessed relative to the outer fold line 29 by a distance ranging from about 30% to about 95%, optionally from about 50% to about 95%, optionally from about 60% to about 90%, of the distance between the outermost outer fold line 29 and the innermost inner fold line 39 as measured orthogonal to the longitudinal axis L. The first pivotable flange 22 can be recessed relative to the outer fold line 29 by a distance ranging from about 30% to about 95%, optionally from about 50% to about 95%, optionally from about 60% to about 90%, of the distance between the outermost outer fold line 29 and the innermost inner fold line 39 of the penultimate first panel 120 as measured orthogonal to the longitudinal axis L.

The first panels 120 and second panels 38 can individually have a height as measured orthogonal to the longitudinal axis L from about 10 mm to about 100 mm, optionally from about 20 mm to about 60 mm, optionally from about 30 mm to about 50 mm. Panels having a height less than 100 mm can be desirable for reducing the quantity of materials required to construct the bag 10. Panels having a height greater than about 10 mm can be practical for improving the ability to control formation of the panels on line from a flat substrate folded into the desired shape.

A recessed first pivotable flange 22 can require the user of the bag 10 to be more deliberate to seek out the first pivotable flange 22 so that the bag 10 can be opened. The bag 10 can be opened by gripping the first pivotable flange 22 in some manner and applying a peeling force to the first pivotable flange 22 with one hand to peel the first pivotable flange 22 away from the repositionable pressure sensitive adhesive 150 joined to the second side sheet 30 which may be held with the other hand or second pivotable flange 32 restrained by the user grasping the second folded portion 36. Optionally, the repositionable pressure sensitive adhesive 150 can be joined to the first pivotable flange 22 and the bag 10 can be opened by peeling the first pivotable flange 22 and repositionable pressure sensitive adhesive 150 with one hand away from second sheet 30 held with the other hand or the second folded portion 36 which is restrained by the user grasping the second sheet 30 or second folded portion 36 thereof. The repositionable pressure sensitive adhesive 150 can be on a surface selected from the second sheet 30, the first exterior part 140, and combinations thereof.

For reference the first folded portion 26 can comprise one or more inner fold lines 39. The inner fold line 39 or inner fold lines 39 of the first folded portion 26 can be positionally between the outer fold line 29 or outer fold lines 29 and the bottom 60. Likewise, the second folded portion 36 can comprise one or more inner fold lines 39 positioned between the outer fold line 29 or outer fold lines 29 of the second folded portion 36 and the bottom 60. The vertex of the inner fold lines 39 can point towards the bottom 60.

The repositionable pressure sensitive adhesive 150 can comprise a backing layer and an adhesive composition. The adhesive composition can be carried on the backing layer. The backing layer can be joined to the first pivotable flange 22. In such an arrangement, the adhesive composition can releasably engage with the second side sheet 30. The adhesive composition can releasably engage with the second side sheet interior facing surface 33, for example when a second pivotable flange 32 is not provided as part of the second side sheet 30. When a second pivotable flange 32 is provided, the adhesive composition can releasably engage with the second pivotable flange 32.

The backing layer can be joined to second pivotable flange 32. In that position, adhesive composition can releasably engage with the first pivotable flange 22. Optionally, the backing layer can be joined to the second side sheet interior facing surface 33. In such arrangements, the adhesive composition can releasably engage with the first pivotable flange 22.

The repositionable pressure sensitive adhesive 150 can be a melding of adhesive composition with some of the adhesive composition being carried on a backing layer joined to the first pivotable flange 22 and some of the adhesive composition being carried on a backing layer joined to the second side sheet 30, or to the second pivotable flange 32 if provided. Such an arrangement is analogous to two lengths of single sided adhesive tape being stuck together with the adhesive sides of each length of tape facing one another.

In an arrangement in which the repositionable pressure sensitive adhesive 150 is directly engaged with the second side sheet 30, if the closed bag 10 is inverted, the closure 40 can resist the contents of the bag 10 from spilling out by way of the peeling resistance between repositionable pressure sensitive adhesive 150 and the second side sheet 30 or depending on how the bag 10 deforms or crumples near the closure 40 a combination of shear resistance, normal resistance, and peeling resistance. The peeling, shear, and normal forces and stresses can arise from the lateral pressure of the contents of the bag 10 pressing outwardly on the first side sheet 20 and second side sheet 30 and from the weight of the contents of the bag 10 on the closure 40.

The first pivotable flange 22 can project exteriorly beyond the pressure sensitive adhesive 150. The part of the first pivotable flange 22 projecting exteriorly beyond the pressure sensitive adhesive 150 is the free portion 160. Having some portion of the first pivotable flange 22 sticking out above the pressure sensitive adhesive 150 outside the interior space 50 can provide a structure for the user to grasp to peel away first pivotable flange 22 from the second pivotable flange 32, if present, or the second side sheet 30, when a second pivotable flange is not provided. The free portion 160 can be positioned between the outer fold line 29 or outer fold lines 29 and the inner fold line 39 or inner fold lines 39. The free portion 160 can be positioned between the outer fold line 29 and the repositionable pressure sensitive adhesive 150. The terminal end 21 of the first pivotable flange 22 can be positioned between the outermost or outer fold line 29 and the repositionable pressure sensitive adhesive 150. The terminal end 21 of the first pivotable flange can be nearer to the repositionable pressure sensitive adhesive 150 than the outermost or outer fold line 29. The free portion 160 can be positioned between the top edge 9 and the repositionable pressure sensitive adhesive 150. The terminal end 21 of the first pivotable flange 22 can be positioned between the top edge 9 and the repositionable pressure sensitive adhesive 150. The terminal end 21 of the first pivotable flange can be nearer to the repositionable pressure sensitive adhesive 150 than the top edge 9. These recessed positions for the terminal end 21 of the free portion 160 or the free portion 160 per se can make it cognitively challenging for users to find the free portion 160 which can make the bag 10 difficult to open.

The free portion 160 can project exteriorly beyond the repositionable pressure sensitive adhesive 150 from one first side sheet transverse edge 70 to the other first side sheet transverse edge 70. In such an arrangement, the user can select any location between the first side sheet transverse edges 70 to access the first pivotable flange 22 and will find the free portion 160, which is an extension of the first pivotable flange 22, that can be grasped.

The free portion 160 can have a free length along the longitudinal axis L. The free length can be less than or equal to the closure length. The closure length and the free length can be measured along the longitudinal axis L. The closure length and free length are scalar quantities. The closure length is a measure of the length of the part of the closure 40 that is intended to be opened and re-closed. The free length is the length of the free portion 160 along the longitudinal axis L. The closure length can be the length from one first side sheet transverse edge 70 and second side sheet transverse edge 100 to the opposing first side sheet transverse edge 70 and second side sheet transverse edge 100.

The free length can be the same as the closure length. In such an arrangement, the user can grasp or pinch the portion of the free portion 160 projecting exteriorly beyond the repositionable pressure sensitive adhesive 150 at any location along the longitudinal axis L to open the bag 10, for example by applying a peeling force to the free portion 160 with one hand to peel the first pivotable flange 22 and the second side sheet 30 or second folded portion 36 held with the other hand apart from one another. This can make the bag 10 more easily opened than if the free portion 160 is shorter. For example, the free length can be less than about 20%, optionally less than about 10%, optionally less than about 5%, of the closure length. Such an arrangement can make it cognitively challenging for the user to find the free portion 160 so that the bag 10 can be easily opened. The free portion 160 can be located at or near the midpoint of the closure 40 along the longitudinal axis L. Optionally, the free portion 160 can be located nearer to one of the transverse edges of the bag 10 than the midpoint of the closure 40 along the longitudinal axis L. The free portion 160 can have a length along the longitudinal axis L from about 10 mm to about 40 mm, optionally about 15 mm to about 30 mm. The greater the length of the free portion 160, the easier it will be for the user to find the free portion 160. Conversely, a short free portion 160 can be desirable if the designer of the package wishes to make it cognitively challenging for the user to find the free portion 160.

Optionally, the closure 40 can comprise two free portions 160. Optionally, one of the free portions 160 can be located nearer to one set of the transverse edges of the bag 10 than the midpoint of the closure 40 along the longitudinal axis L and the other free portion 160 can located nearer to the opposite set of transverse edges of the bag 10 than the midpoint of the closure 40 along the longitudinal axis L. In this arrangement, the closure 40 can have two free portions 160, each of which is near one set of transverse edges than a midpoint of the closure 40 along the longitudinal axis L. That is, the two free portions 160 can be located towards, at, proximal, or near opposite ends of the closure 40. Such an arrangement can provide for ambidextrous opening of the bag 10 in that at least one free portion 160 is located at a set of transverse edges that users may tend to orient away from their body when opening the bag 10.

The free portion 160 can have a free length that is shorter than the closure length. In such an arrangement the free portion 160 can be a tab 24 that the user can manipulate to impart the necessary forces to peel apart the closure 40. The tab 24 can be an extension of the free portion 160, which can make it easier for the user to find the free portion 160. Optionally, the free portion 160 per se can be the tab 24 in that only the tab 24 projects exteriorly beyond the repositionable pressure sensitive adhesive 150. Providing a relatively short free portion 160 sticking out above the pressure sensitive adhesive 15 can necessitate the user to expend considerable cognitive effort to identify the free portion 160 and determine how to manipulate the free portion 160 to open the closure 40. The tab 24 can be sized and dimensioned to be grasped or pinched by adult human fingers or sized and dimensioned to be pinched by the user's thumb against other parts of the first folded portion 26 supported from outside the bag 10 by the side of the user's index finger oriented towards the thumb of the same hand.

A least a portion of the free portion 160 or tab 24 can contrast in color with the first side sheet 20 or portion of the first side sheet 20 from which the free flange or tab 24 extends. Such an arrangement can help the user find the free portion 160 to open the closure. If the free portion 160 has a short free flange length, providing the free portion 160 with a color that contrasts with other parts of the closure can be particularly practical since there may only be a small tab for the user to use to peel the closure 40 apart.

Figure 5:
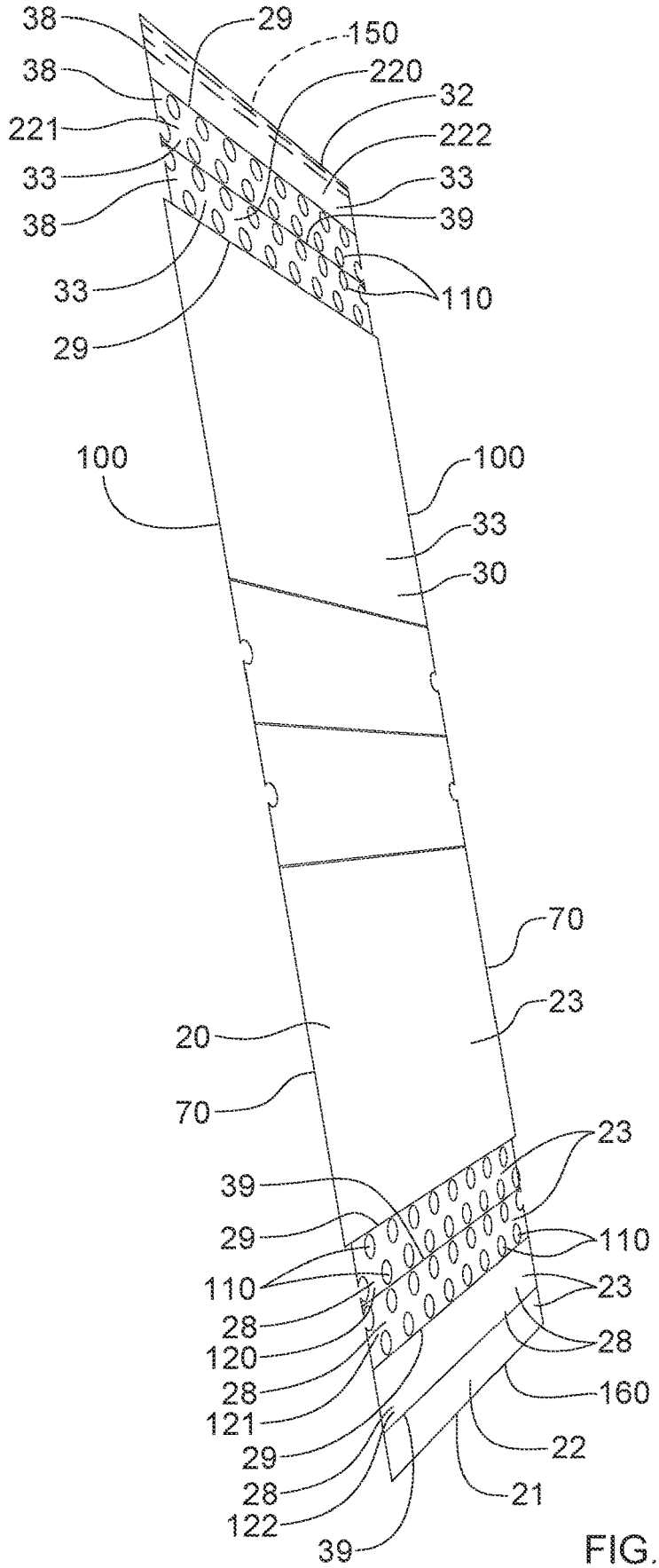
FIG. 5 is a perspective view of a blank that can be formed into a bag.

A perspective view of a blank from which a bag 10 can be constructed is shown in FIG. 5. As shown in FIG. 5, multiple rows of apertures 110 can be provided in one or both of the first folded portion 26 and second folded portion 36

Figure 6:
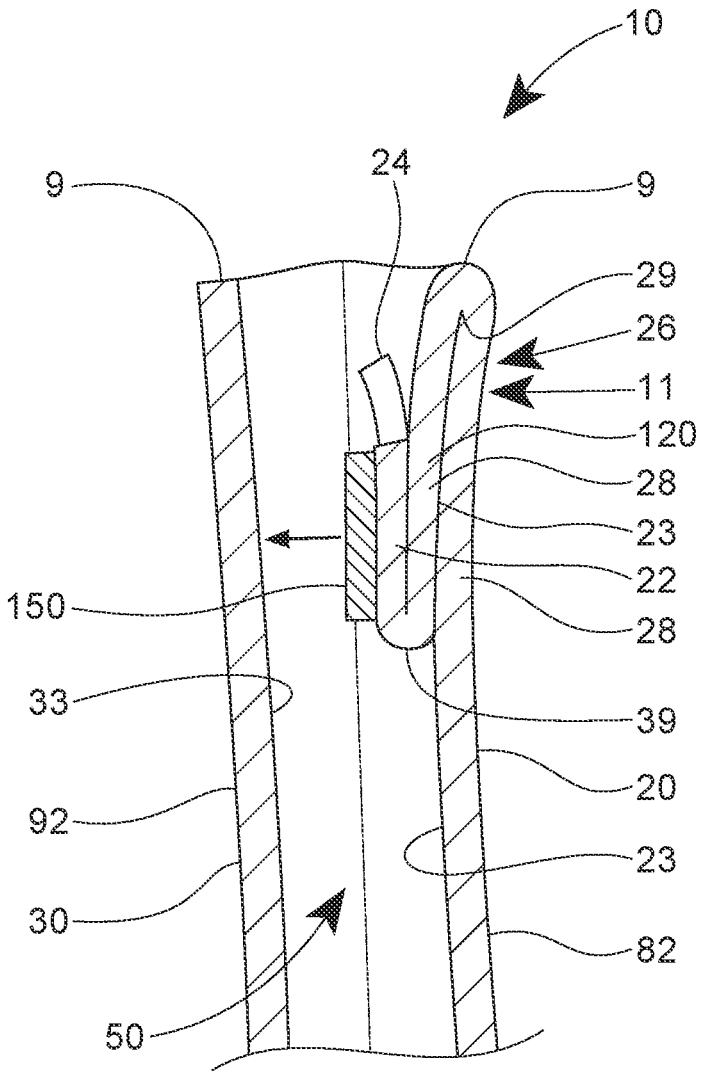
FIG. 6 is a cross sectional view of part of a bag in which the pressure sensitive adhesive is engaged with the second side sheet interior facing surface.

As described herein, the closure 40 can comprise a repositionable pressure sensitive adhesive 150 releasably engaging the first pivotable flange 22 directly or indirectly to the second side sheet interior facing surface 33 (FIG. 6). Arranged as such, the interior space 50 of the bag 10 can be closed off from the exterior environment and the bag can be opened by disengaging, for example by peeling, the first pivotable flange 22 from the second side sheet interior facing surface 33. For the arrangement shown in FIG. 2, the interior space 50 is defined by part of the first side sheet 20, part of the second side sheet 30, and the second pivotable flange 32, notwithstanding the insignificant volumetric contributions of the pressure sensitive adhesive 150 and the inner fold line 39. The repositionable pressure sensitive adhesive 150 can be releasably engaged with one of the second side sheet interior facing surface 33 or the second pivotable flange 32. Optionally, repositionable pressure sensitive adhesive 150 can be applied to both the second side sheet interior facing surface 33 and the first pivotable flange 22.

Figure 7:
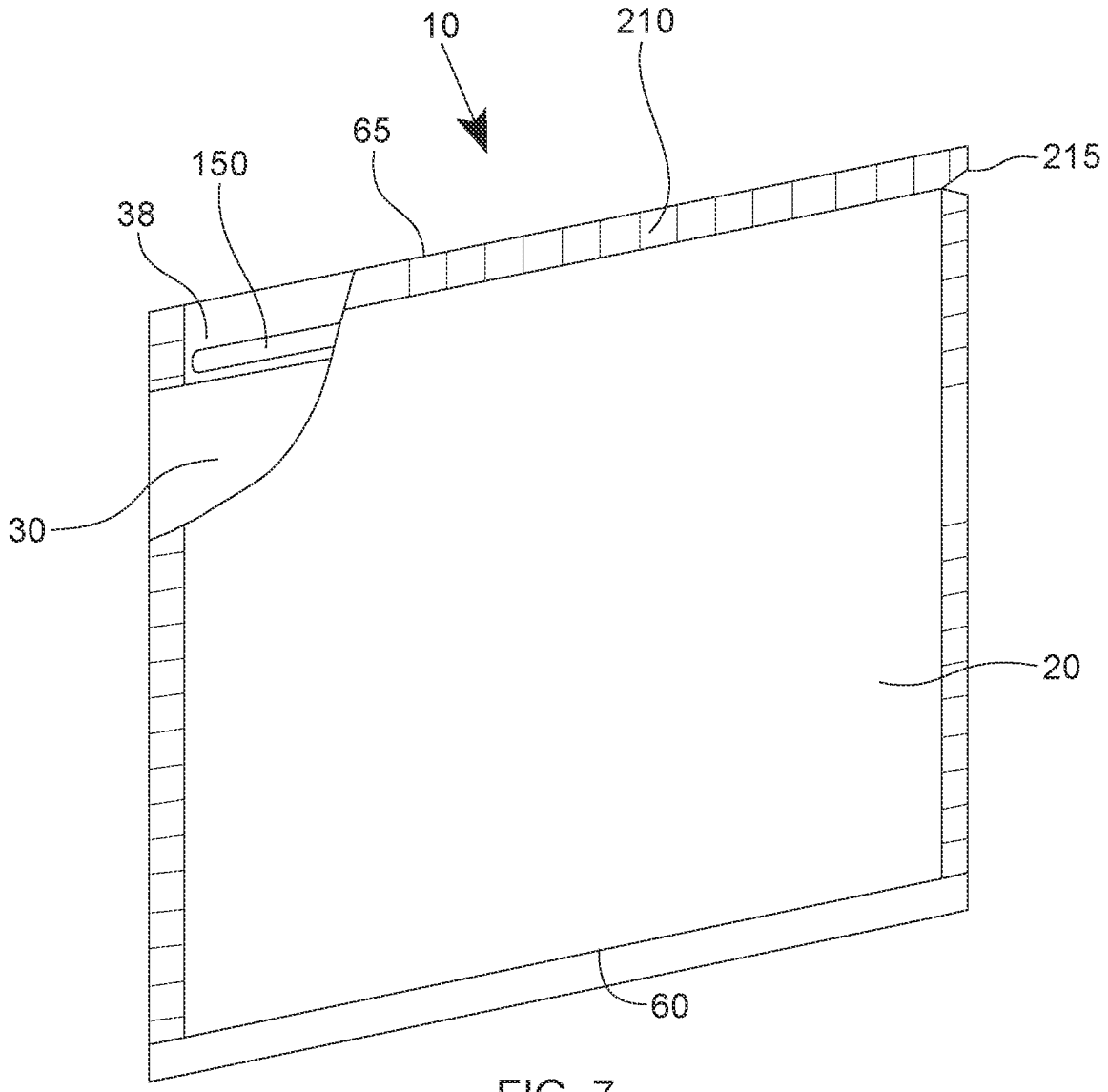
FIG. 7 is a perspective view of a bag having a removable tear strip.

The bag 10 can have a removable tear strip 210 to provide a structure to protect the closure 40 from opening unintentionally after the bag 10 is sealed in the packaging facility until the user desires to access the articles 2 (FIG. 7). The removeable tear strip 210 can be a predetermined line of weakness proximal the top of the bag 10. The removable tear strip 210 can join the first side sheet 20 to the second side sheet 30. The line of weakness can be a series of through perforations, through slits, partial perforations, scores, or other structural weakening of one or both of the first side sheet 20 and second side sheet 30. The line of weakness can be an intermittent cut and formed by a laser. The removable tear strip 210 can have an initiation end 215 to concentrate and direct the tearing force applied by the user towards the removable tear strip 210.

The first side sheet 20 and second side sheet 30 can be joined to one another at the first side sheet transverse edges 70 and the second side sheet transverse edges 100, top 65, and or bottom 60 by a heat seal, glue, adhesive, stitching, or the like. Optionally, the first side sheet 20 and second side sheet 30 can be continuous with one another as described herein across any one of the first side sheet transverse edges 70 and second side sheet transverse edges 100, top 65, or bottom 60. One or both of the first side sheet interior facing surface 23 and the second side sheet interior facing surface 33 can be a coating or film of a composition that is heat sealable, by way of nonlimiting example, a thermoplastic material.

Figure 8:
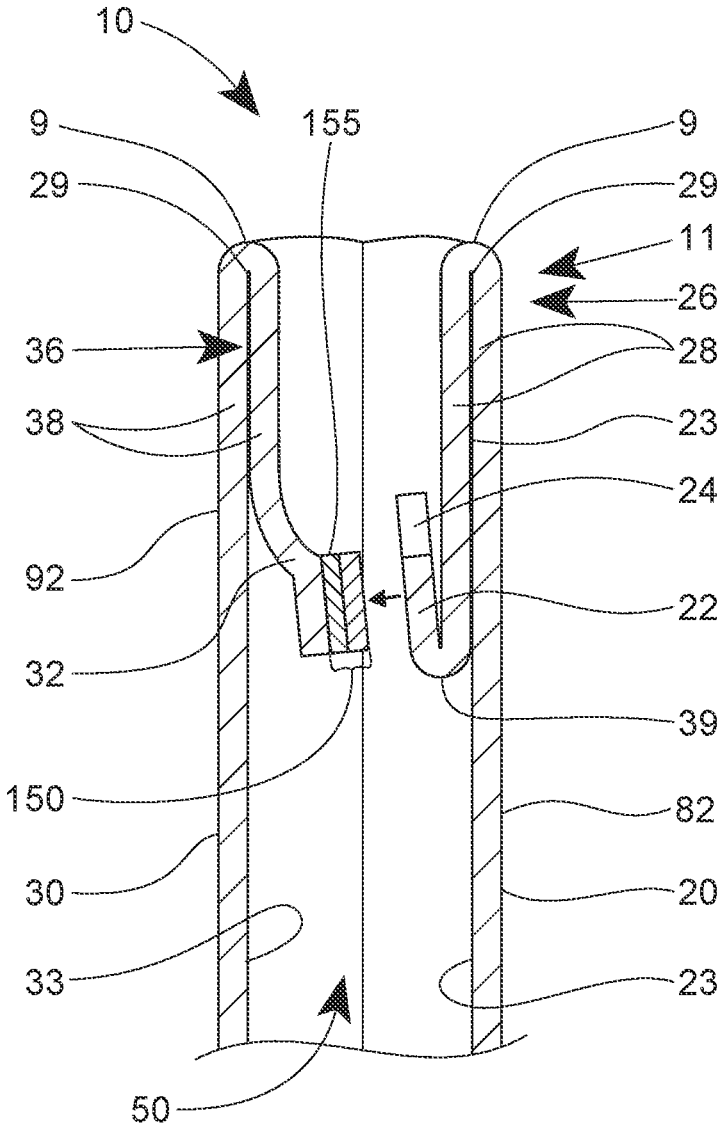
FIG. 8 is a cross section of part of a bag in which the pressure sensitive adhesive is on a backing layer joined to the second pivotable flange.

The repositionable pressure sensitive adhesive 150 can comprise a backing layer 155 upon which the adhesive composition carried (FIG. 8). The backing layer 155 can be joined to the first pivotable flange 22 or second pivotable flange 32. Optionally, if a second pivotable flange 32 is not provided, the backing layer 155 can be joined to the second side sheet interior facing surface 33. The backing layer 155 can be joined to the first pivotable flange 22, second pivotable flange 32, or second side sheet interior facing surface 33 by a heat seal, glue, adhesive, stitching, or the like. The bond joining the backing layer 155 thereto can be stronger with respect to shear, normal, and peeling forces than the repositionable pressure sensitive adhesive 150 against the constituent materials forming the first side sheet 20, second side sheet 30, or a release layer or modification associated with one of those constituent materials, so that the backing layer 155 does not separate from the part to which the backing layer is joined when the bag 10 and contents therein are inverted.

The bag 10 can be more than about 80%, optionally more than about 90%, optionally more than about 95% by weight paper. The greater the weight fraction of paper, the more easily the bag 10 can be recycled.

The bag 10 can be a quad-sealed bag, gusset bag, back sealed bag, 3-sided sealed bag, K-seal stand up bag, round-seal stand up bag, or normal-seal stand up bag.

Figure 9:
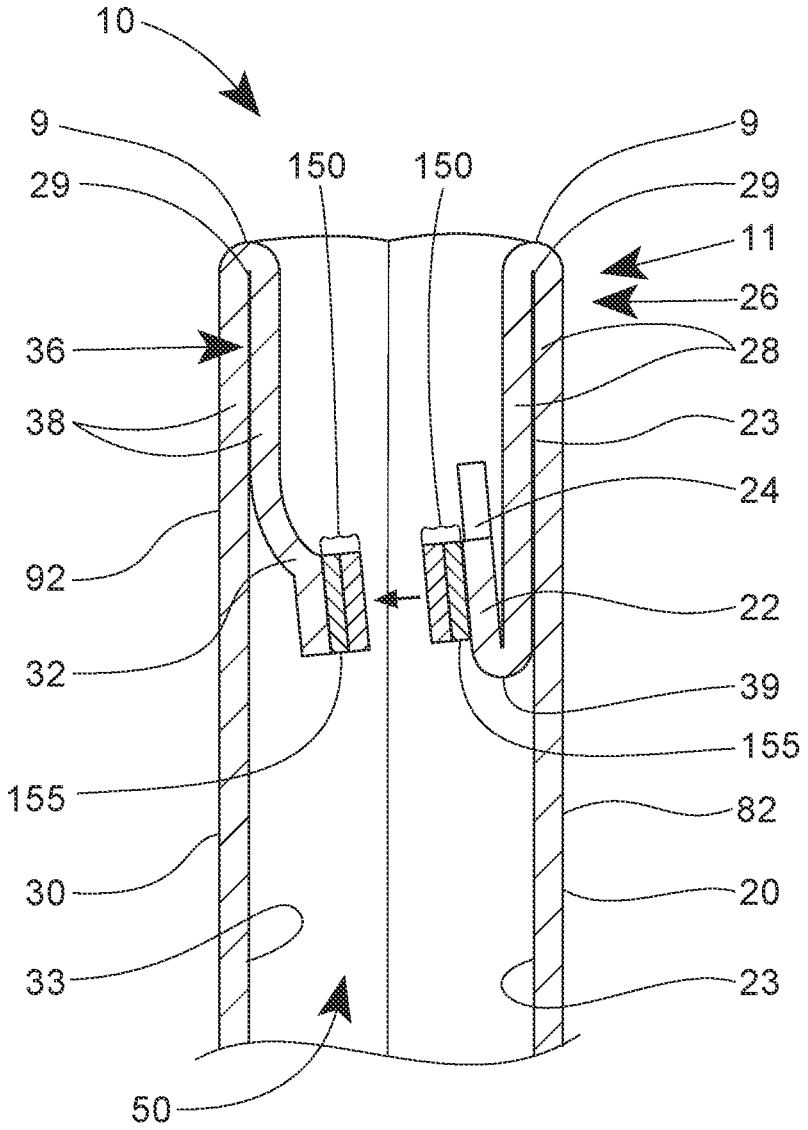
FIG. 9 is a cross section of part of a bag in which some of the pressure sensitive adhesive is on a backing layer joined to the second pivotable flange and some of the pressure sensitive adhesive is on a backing layer joined to the first pivotable flange.

The repositionable pressure sensitive adhesive 150 can be provided on both the first pivotable flange 22 and the second pivotable flange 32. For example a portion of the adhesive composition can be carried on a backing layer 155 joined to the first pivotable flange 22 and another portion of the adhesive composition can be carried on a backing layer 155 joined to the second pivotable flange 32, by way of nonlimiting example as shown in FIG. 9. In this arrangement, the bag 10 can be opened by pulling the pivotable flange 22 away, with one hand, from the second pivotable flange 32, with the other hand, and some of the adhesive composition remains on the backing layer 155 joined to the first pivotable flange 22 and some of the adhesive composition remains on the backing layer 155 joined to the second pivotable flange 32. This arrangement can provide for mechanical behavior similar to when the adhesive sides of two lengths of adhesive tape are contacted face to face with one another along their length and then peeled away from one another, with the similarity being for wide widths of tape peeled in that manner.

The bag 10 can be opened by a method comprising multiple steps. The second folded portion 36 can be grasped with one hand. The first pivotable flange 22 can be grasped with the other hand and the first pivotable flange 22 and the second pivotable flange 32 can be peeled away from one another to peel the first pivotable flange 22 from the second pivotable flange 32 along the repositionable pressure sensitive adhesive 150 to open the bag 10. The first pivotable flange 22 can be grasped at the free portion 160 or optionally tab 24. Optionally, the first pivotable flange 22 and the second pivotable flange 32 can be reengaged with one another along the repositionable pressure sensitive adhesive 150 to close the bag 10.

Optionally the method of opening the bag 10 can comprise multiple steps. The second side sheet 30 can be grasped at the top edge 9 of the second side sheet 30 with one hand. The free portion 160 or optionally tab 24 can also be grasped with another hand. The free portion 160 and the second side sheet 30 can be peeled away from one another along the repositionable pressure sensitive adhesive 150 to open the bag 10. Optionally, the method can comprise the step of reengaging the first pivotable flange 22 and the second side sheet 30 with one another along the repositionable pressure sensitive adhesive 150 to close the bag 10.

Substrates

Paper is a web of cellulose fibers, optionally comprising a minority of additional constituents. To provide for recyclability of the bag 10, the bag 10 can be predominantly constructed from substrates that are paper based. A paper based substrate has more than 80% by weight cellulose fibers. The paper based substrates may have various coatings, varnishes, ink, and the like that are typical for paper based packages and such materials are considered part of a paper based substrate. The web of cellulose fibers constituting the paper based substrate may also contain a minority of other additives and fillers for technical benefits, such materials are also being considered part of the paper base. The first side sheet 20 and the second side sheet 30 can each be more than about 80% by weight paper, optionally more than about 90% by weight paper, optionally more than about 95% by weight paper. The weight of each of the first side sheet 20 and the second side sheet 30 is inclusive of coatings, varnishes, ink, additives, and fillers. The first side sheet 20 and the second side sheet 30 can comprise cellulose fibers having a length from about 0.1 mm to about 5 mm, optionally from about 0.5 mm to about 4 mm, optionally from about 0.5 mm to about 1.5 mm. Shorter fibers tend to provide for a smoother surface as compared to longer fibers and longer fibers tend to provide for greater strength compared to shorter fibers.

The first side sheet 20 and second side sheet 30 can be paper based. One or both of the first side sheet interior facing surface 23 and the second side sheet interior facing surface 33 can be a coating or a local coating only where necessary with a thermoplastic material to facilitate joining the first side sheet 20 and the second side sheet 30. A coating forming the first side sheet interior facing surface 23 can also facilitate joining the first panels 28 to one another. A coating on the second side sheet interior facing surface 33 can also facilitate joining the second panels 38 to one another. The bag 10 can be formed by folding the paper based substrate across the bottom 60 of the bag 10 and the first side sheet 20 and second side sheet 30 can be heat sealed to one another to form a heat seal at the junction of a first side sheet transverse edge 70 and a second side sheet transverse edge 100.

Further, the first side sheet interior facing surface 23 and second side sheet interior facing surface 33 can be a coating of a thermoplastic material to resist oxygen, water, and or water vapor transmission through the respective panel. Likewise, the exterior facing surfaces of the first side sheet 20 and second side sheet 30 can comprise a coating, varnish, or ink, to provide for the desired overall aesthetic, quality printing, and or technical performance of bag 10.

The first side sheet interior facing surface 23 and second side sheet interior facing surface 33 can be a coating of a thin layer of thermoplastic coating. The coating can be selected from, by way of nonlimiting example, low density polyethylene, linear low density polyethylene, high density polyethylene, polypropylene, polyacrylamide, linear polyacrylamide, styrene butadiene copolymer, and combinations thereof. The coating can be a slot coated, spray coated, extrusion coated, dispersed, or printed onto the skeleton of the paper based substrate. Optionally, the coating can be applied as a powder that is heated and or compressed to form the coating. A coating forming the first side sheet interior facing surface 23 and or second sheet interior facing surface 33 can facilitate heat sealing, acoustic sealing, or hot melt sealing of the of the first side sheet interior facing surface 23 to the second side sheet interior facing surface 33 along a first side sheet transverse edge 70 and a second side sheet transverse edge 100. The interior facing surfaces a coating in locations at which and near to where heat sealing is employed to join the elements of the bag 10. Optionally, portions of the interior facing surfaces may be uncoated. Optionally, portions of the interior facing surfaces can be uncoated so that that paper is exposed to the contents of the bag 10. The paper can help draw away moisture from the contents or air space within the bag 10. This might be practical if the contents are soluble unit dose laundry products since excess moisture may form pinholes in the products or may cause the products to stick to one another. The interior facing surfaces can be uncoated, which might be practical if glue or other adhesive is employed to join the elements of the bag 10. Optionally, the exterior facing surfaces may be coated with a thin layer of thermoplastic coating to limit or prevent ingress of moisture into the bag 10. Optionally, the first side sheet 20 and second side sheet 30 can be a paper laminate in which an interior layer is a layer of thermoplastic material, which can limit or prevent ingress of moisture into the bag 10 and leave a paper material exposed to the interior space 50 of the bag 10.

The paper based substrates forming the first side sheet 20 and second side sheet 30 can have a basis weight, inclusive of the coatings, varnishes, ink, additives, and fillers, from about 20 to about 500 g/m$^2$, optionally from about 20 to about 300 g/m$^2$, optionally from about 30 to about 150 g/m$^2$. The first side sheet exterior facing surface 82 and the second side sheet exterior facing surface 92 can comprise a non-continuously coated or uncoated. Less than about 10%, optionally less than about 5%, by area of the first side sheet exterior facing surface 82 and the second side sheet exterior facing surface 92 can be coated or be provided with a release material. To improve recyclability, it can be beneficial that at least one surface of the each of the sheets be non-continuously coated, uncoated, or only have a small areal portion coated so that the paper constituting such panel can be easily separated from any coating employed. Moreover, uncoated, non-continuously coated, or substantially uncoated (e.g. less than about 10% of the first side sheet exterior facing surface 82 and the second side sheet exterior facing surface 92, or lesser percentage as described above) exterior facing surfaces can make it apparent to the user of the bag 10 that the bag 10 is intended to be recycled in the paper recycling stream. The paper based substrates for the side panels and flexible angles can be, by way of nonlimiting example, MONDI AEGIS 84 grams per square meter white or MONDI AEGIS 136 grams per square meter brown, available from Mondi, PLC, Addlestone, Surrey, United Kingdom.

The thermoplastic coating can have a thickness from about 2 m to about 50 m, optionally from about 4 m to about 30 m, optionally from about 6 m to about 20 m. The thermoplastic coating can be polyethylene.

The portion of any substrate from which the repositionable pressure sensitive adhesive 150 is released may be surface treated or include a release layer or material so that the repositionable pressure sensitive adhesive 150 releases cleanly therefrom. For example, the surface may be treated with a silicone release coating or wax. Optionally, the release layer can be a thin layer of low density polyethylene, linear low density polyethylene, high density polyethylene, polypropylene, polyacrylamide, linear polyacrylamide, or similar thermoplastic polymer engaged with the substrate.

Repositionable Pressure Sensitive Adhesive and Backing Layer

The repositionable pressure sensitive adhesive 150 provides for the ability to reseal the bag 10 after opening the closure 40. A repositionable pressure sensitive adhesive 150 comprises an adhesive composition that bonds to a substrate by the application of pressure. The pressure sensitive adhesive 150 can have an average peak tack force measured according ASTM D6195-03 (Reapproved 2019) Test Method A (Using a Tensile Tester) that diminishes by less than 80%, optionally less than 60%, optionally less than 50%, optionally less than 20%, after 80 opening and closing cycles of the pressure sensitive adhesive 150 against the surface to which the pressure sensitive adhesive 150 is engaged in the bag 10. A peak tack force that degrades to some degree as a function of cycles may not overly impair function of closure since some of the contents of the bag 10 are likely to be removed from the bag 10 each time the user opens and closes the bag 10 which tends to lessen the strength of the closure 40 needed to make it likely that the bag 10 can remain closed when the bag 10 is inverted. A repositionable pressure sensitive adhesive 150 can be repositionable from about 10 to about 200 times. The repositionable pressure sensitive adhesive 150 can be repositionable for from about 1 to about 24 months. The bonding strength may be influenced by the amount of pressure applied and characteristics of the substrate such as smoothness and surface energy. The adhesive composition of the repositionable pressure sensitive adhesive 150 tends to exhibit viscoelastic behavior. The adhesive composition of a repositionable pressure sensitive adhesive 150 forms a bond to a substrate by way of the adhesive composition flowing to wet the substrate with the repositionable pressure sensitive adhesive 150. The integrity of the bond is maintained by the cohesive strength of adhesive composition and the molecular interactions between the adhesive composition and substrate. The adhesive composition can form viscoelastic bonds that are permanently tacky and adhere when pressure is manually applied and no activation, for example water, solvent, or heat, is required.

The repositionable pressure sensitive adhesive 150 can comprise various compositions and can be comprised of elastomeric polymers with or without tackifiers. The adhesive composition of the repositionable pressure sensitive adhesive 150 can be selected from acrylic and methacrylic ester homo or copolymers, butyl rubber based systems, silicones, nitriles, styrene block copolymers, ethylene vinyl acetate, urethanes, vinyl esters and amides, olefin copolymer materials, natural or synthetic rubber, and the mixtures thereof. The adhesive composition of the repositionable pressure sensitive adhesive 150 can be selected from rubber adhesive, acrylic adhesive, modified acrylic adhesive, silicone adhesive, and combinations thereof. Rubber or rubber-based adhesive compositions may not perform as well as other repositionable pressure sensitive adhesives 150.

The repositionable pressure sensitive adhesive 150 is a removable repositionable pressure sensitive adhesive 150 in that the repositionable pressure sensitive adhesive 150 can be separated from the substrate without damage to the repositionable pressure sensitive adhesive 150 per se or the substrate to which it is adhered. The repositionable pressure sensitive adhesive 150 can provide for unsealing and resealing of the closure 40 from about 10 to 200 times. The repositionable pressure sensitive adhesive 150 can be AR101, SR106, R1490M, SR692N, available from AVERY DENNISON, Glendale, California, United States of America.

The adhesive composition can be applied directly to the substrate or can be carried on a backing layer 155 that is joined to the substrate so that the backing layer 155 is between the adhesive composition and the substrate. The backing layer 155 can be paper, film, or foil. Suitable backing layers 155 include polymers, including, but not limited to, polyethylene terephthalate, polyethylene, polypropylene, copolymers such as polyethylene-propylene, polyethylene-octene, olefinic block copolymer and polystyrene films. The backing layer 155 can be selected from polyester, polypropylene, polyethylene, polyethylene/polypropylene co-polymer, UHMS-PE, polyvinyl chloride, polyimide, polyamide, polytetrafluoroethylene, polyvinyl alcohol, polyurethane, polyvinyl fluoride, and combinations thereof. The backing layer 155 can be selected from crepe paper, flatback paper, kraft paper, machine glazed uncoated kraft paper, machine finished uncoated kraft paper, parchment, super calendered kraft paper, clay-coated kraft paper, poly-coated kraft paper, glassine paper, and combinations thereof. The backing layer 155 can be selected from cotton cloth, glass cloth, vinyl cloth, and combinations thereof. The backing layer 155 can be fibrous. The backing layer 155 can be aluminum, copper, lead, stainless steel, and combinations thereof. The backing layer 155 can be neoprene. The backing layer 155 can have a basis weight from about 50 $g/m^2$ to about 400 $g/m^2$, optionally from about 80 $g/m^2$ to about 300 $g/m^2$, optionally from about 100 $g/m^2$ to about 200 $g/m^2$. A paper based backing layer 155 may be beneficial to improve the recyclability of the bag 10.

The backing layer 155 can be joined to the substrate by a heat seal, glue, adhesive, stitching, or the like. The adhesive composition can be present as a continuous coating on one side of the backing layer 155. Optionally, the adhesive composition can coat less than the entirety of one side of the backing layer 155. The adhesive composition can be a discontinuous coating, for example islands of adhesive composition, on one side of the backing layer 155. The adhesive composition can have a thickness from about 5 microns to about 500 microns.

The repositionable pressure sensitive adhesive 150 can be on a surface selected from the first side sheet interior facing surface 23, the second side sheet interior facing surface 33, the second side sheet exterior facing surface 92, and combinations thereof.

The repositionable pressure sensitive adhesive 150 can comprise a water based acrylic repositionable adhesive composition. The repositionable pressure sensitive adhesive 150 can comprise a water based styrene butadiene copolymer latex adhesive composition. The repositionable pressure sensitive adhesive 150 can comprise a rubber based adhesive composition sensitive adhesive in a solvent solution. The repositionable pressure sensitive adhesive 150 can comprise a polyurethane elastomer based adhesive composition. The repositionable pressure sensitive adhesive 150 can be IVY GRIP TAPE, available from HONGXIN-SHOP on www.amazon.com as of Mar. 26, 2021. The repositionable pressure sensitive adhesive 150 can comprise a hotmelt adhesive. Hotmelt adhesive composition may provide more flexibility in the formulation chemistry of such hotmelt.

The repositionable pressure sensitive adhesive 150 can comprise, by way of nonlimiting example, TACKWHITE NA 55, TACKWHITE AMC 20, TACKWHITE AMC 3 D, TACKWHITE AMC 24, TACKWHITE AMC 4 D, TACKWHITE AP 5M, TACKWHITE SB4 B2, TACKWHITE SB5 SL5, SOLACRIL SPR 12 M3, SOLACRIL WS 33, SOLACRIL 44, SOLACRIL WS 60, SOLACRIL WS 40 N, SOLACRIL 206, SOLACRIL 306, SOLACRIL 203, SOLACRIL 303, or TACKMELT R 008, available from ICHEMCO, Milan, Italy, as the adhesive composition. The repositionable pressure sensitive adhesive 150 can comprise be ROBOND PS-9260, ROBOND, PS-8120HV, or ROBOND PS-8942, available from Dow, Inc., Midland, Michigan, United States of America, as the adhesive composition. The repositionable pressure sensitive adhesive 150 can comprise styrene-isoprene-styrene copolymer (SIS) as the adhesive composition. The repositionable pressure sensitive adhesive 150 can comprise SAVARE PL501ZK, available from SAVARE I.C. srl, Milano, Italy, as the adhesive composition. The repositionable pressure sensitive adhesive 150 can comprise a mixture of ethylene-vinyl acetate and styrene block copolymer, for example a fashion tape such as FASHION TAPE sold by www.hollywoodfashionsecrets.com, as the adhesive composition. The repositionable pressure sensitive adhesive 150 can have a load at failure according to ASTM D3165-07(2014) from about 0.05 to about 0.5 MPa. The repositionable pressure sensitive adhesive 150 can have an average T-peel strength according to ASTM D903-98(2017) from about 0.01 to about 0.5 N/mm.

Figure 10:
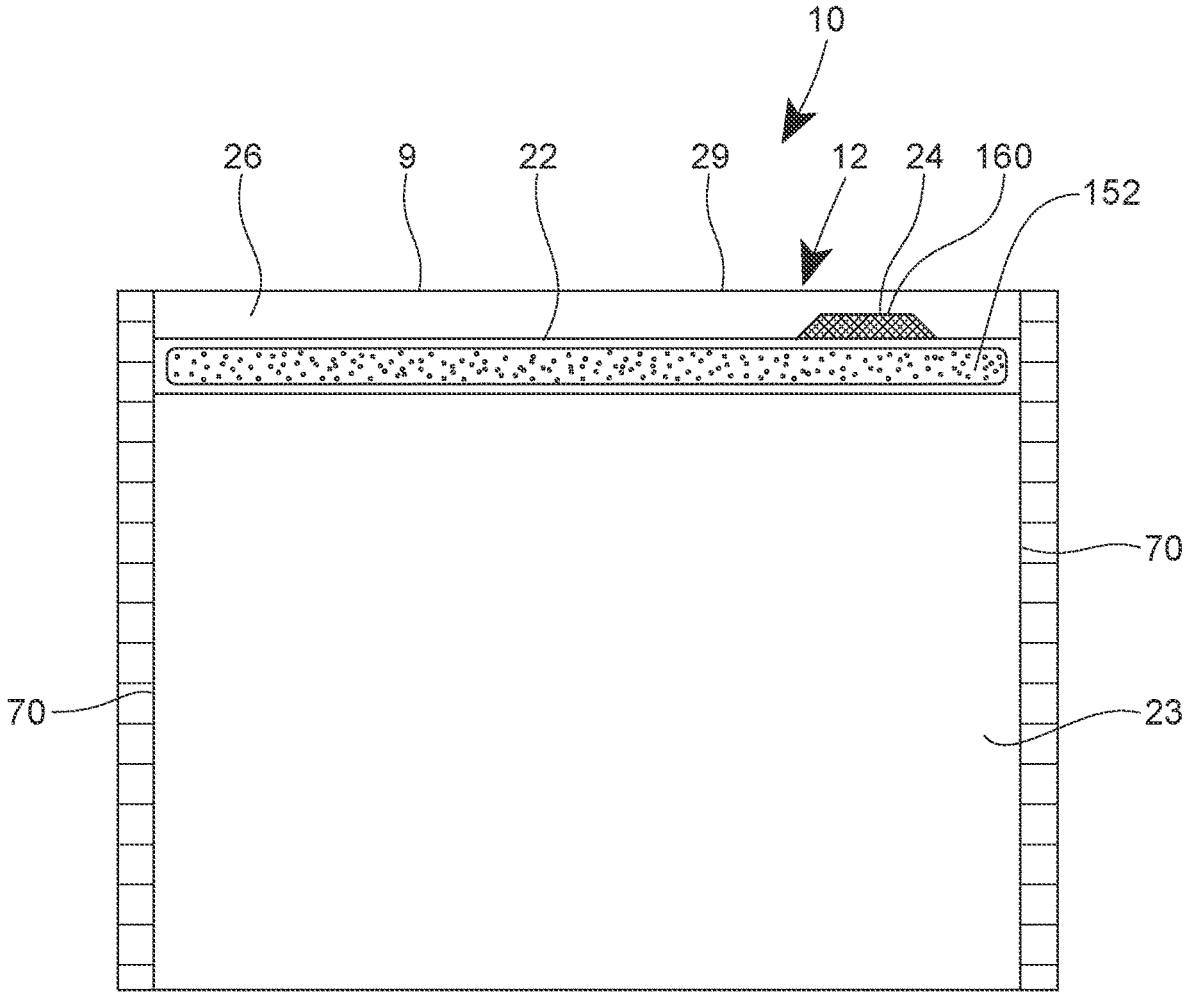
FIG. 10 is a side view of the first side sheet with the first side sheet interior facing surface oriented towards the viewer and illustrating the first pivotable flange and release zone.

The first pivotable flange 22 can be releasably engaged with the second pivotable flange 32 by the repositionable pressure sensitive adhesive 150 over a release zone 152 (FIG. 10). The release zone 152 can have a release area from about 100 $mm^2$ to about 21000 $mm^2$. The release area is a scalar quantity measurement of the area of the release zone 152. The release zone 152 is the locus at which the first pivotable flange 22 and second side sheet 30 or second folded portion 36 are releasably engaged. The repositionable pressure sensitive adhesive 150 is the material through which the first pivotable flange 22 and the second side sheet 30 or second folded portion 36 are releasably engaged with one another. The release zone 152 may be a continuous area, such as a continuous slot coated area, and may have islands of unengaged portions of the first pivotable flange 22 and the second side sheet 30 or second folded portion 36 which are not part of the release zone and do not count towards the area of the release zone. The release zone 152 may be a discontinuous area, such as islands of repositionable pressure sensitive adhesive, stripes, annuluses, and the like.

The closure length, which is a measure of the length along the longitudinal axis L of the part of the closure 40 that is intended to be opened and re-closed, can be from about 100 mm to about 420 mm. The closure height, which is a measure of the height of the part of the closure 40 that is intended to be opened and re-closed is measured orthogonal to the longitudinal axis L can be from about 1 mm to about 50 mm, optionally from about 5 mm to about 50 mm, optionally from about 5 mm to about 30 mm, optionally from about 10 mm to about 25 mm. Closure heights below 1 mm, or even 5 mm, may be challenging for the user reclose properly since the user may have to carefully attend to identifying and locating the repositionable pressure sensitive adhesive 150 and competently engaging the repositionable pressure sensitive adhesive 150 with the surface to which it is intended to engage. Closures heights greater than 50 mm may be unwieldy for the user to work with. A closure height greater than 50 mm may fold or wrinkle uncontrollably when the closure 40 is open and adjacent portions of the repositionable pressure sensitive adhesive 150 may become engaged with one another, making the closure 40 difficult to properly reclose. Further, large closures 40 may increase non paper based fraction of the bag 10 since a greater quantity of repositionable pressure sensitive adhesive 150 may be used. Opening and reclosing the closure 40 multiple times may contaminate the pressure sensitive adhesive 150 or the surface to which it engages. The contamination source may be, by way of nonlimiting example, dust from the air, dust from the contents of the bag 10, oil or other substance transferred from the user's fingers, water, or other substance to which the closure 40 is exposed when the closure 40 is open. The greater the closure height, the less sensitive the closure 40 might be to contamination. A closure height less than 1 mm may be more sensitive to contamination than desired.

The bag 10 can contain from about 10 g to about 5000 g of articles 2. The bag 10 can contain from about 100 g to about 2500 g of articles 2. The bag 10 can contain from about 400 g to about 1800 g of articles 2. The ratio of the release area to the mass of articles 2 contained in the bag 10 can be from about 80 $mm^2$ per 100 g to about 1250 $mm^2$ per 100 g, optionally from about 250 $mm^2$ per 100 g to about 1000 $mm^2$ per 100 g, optionally from about 300 $mm^2$ per 100 g to about 800 $mm^2$ per 100 g.

For a bag 10 containing articles 2, in consistent units, the product of the load at failure according to ASTM D3165-07(2014) of the repositionable pressure sensitive adhesive 150 and the release area can be from about 2 to about 500, optionally from about 20 to about 300, optionally from about 50 to about 200, optionally from about 80 to 180 times greater than the cumulative weight of articles 2 contained in the bag 10. The load at failure according to ASTM D3165-07(2014) is reported in megapascals. Converting the load at failure according to ASTM D3165-07(2014) can be avoided in the aforesaid relationship by providing the release area in square meters and the force induced by the weight of articles 2 in the bag 10 in meganewtons. Without being bound by theory it is thought that by providing the product of the load at failure according to ASTM D3165-07(2014) of the repositionable pressure sensitive adhesive 150 and the release area in the range of from about 2 to about 500 times, optionally from about 5 to about 300 times, optionally from about 5 to about 100 times, optionally from about 2 to about 50 times, optionally from about 2 to about 20 times, greater than the weight of articles 2 contained in the bag 10 sufficiently limits the likelihood of viscoelastic failure of the adhesive 150 under the expected use over the expected life-cycle of the bag 10 and articles 2 contained therein.

Contents of the Bag

The bag 10 can contain dry food product. The dry food product can be for animal consumption, including human consumption. The dry food product can be, by way of nonlimiting example, food pellets, grain products, ground grain products, hops, powder, chips, fruit, dried fruit, dried fungi, legumes, coffee, sugar, corn products, tea, salt, spices, and the like. The bag 10 can contain fibrous water soluble products, for example nonwoven webs of water soluble fibers that carry fabric care actives, oral care actives, hair care actives, or skin care or cleaning actives, hard surface care actives, and the like. The bag 10 can contain, by way of nonlimiting example, disposable absorbent articles, incontinence garments, bibs, diapers, sanitary napkins, panty liners, tampons, training pants, wipes, hand soaps, oral care implements, products for treating hair, products for treating skin, personal cleansing articles, orally administered products, fabric and laundry conditioning products, fabric or laundry care and or detergent products, dishwashing products, cleaning products, hard surface cleaning products, oral care products, lozenges, topical or oral pain relievers, nutritional supplements, vitamins, probiotic, nutritional fiber, nutritional minerals, pet food, razors, grooming implements, food products for human consumption, food products for domesticated animal consumption, food products for wild animal consumption, and the like.

The bag 10 can contain a liquid composition, a gel composition, a paste, a dispersion, a solid composition, or a plurality of articles 2. The liquid composition, gel composition, paste, dispersion, solid composition, or plurality of articles 2 can be, by way of nonlimiting example, a detergent composition, a laundry fabric softener, a laundry scent additive, a laundry care additive. The liquid composition, gel composition, paste, dispersion, solid composition, or plurality of articles 2 can be, by way of nonlimiting example, an automatic dishwashing detergent or a hard surface treatment composition. The solid composition can be, by way of nonlimiting example, blown powder, crystals, coated crystals, melt formed bodies, extruded particles, spheronized particles, molded particles, tablets, and the like. The solid composition can be free flowing or compacted, by way of nonlimiting example.

The articles 2 can be water-soluble unit dose articles 2. The water-soluble unit dose articles 2 can be a water-soluble pouch containing a unitary dose of a composition as a volume sufficient to provide a benefit in an end application. The bag 10 can comprise from about 1 to about 100 water-soluble unit dose articles 2.

The water-soluble unit dose article 2 can comprise at least one water-soluble film shaped such that the unit-dose article comprises at least one internal compartment surrounded by the water-soluble film. The at least one compartment can comprise a detergent composition. The water-soluble film can be sealed such that the detergent composition does not leak out of the compartment during storage. Upon addition of the water-soluble unit dose article to water, the water-soluble film can dissolve and releases the contents of the internal compartment into the wash liquor. The detergent composition can be a liquid or solid.

The unit dose article 2 may comprise more than one compartment, even at least two compartments, or even at least three compartments, or even at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may even be orientated in a 'tire and rim' arrangement, i.e. a first compartment is positioned next to a second compartment, but the first compartment at least partially surrounds the second compartment, but does not completely enclose the second compartment. Alternatively, one compartment may be completely enclosed within another compartment.

Each individual unit dose article 2 may have a weight of between 10 g and 40 g, or even between 15 g and 35 g.

The water-soluble film of the unit dose article 2 can be soluble or dispersible in water. Prior to be being formed into a unit dose article 2, the water-soluble film can have a thickness of from 20 to 150 micron.

The film materials can be polymeric materials. The film material can, for example, be obtained by casting, blow-molding, extrusion or blown extrusion of the polymeric material. The water-soluble film can comprise polyvinyl alcohol homopolymer or polyvinyl alcohol copolymer, optionally a blend of polyvinylalcohol polymers and/or polyvinylalcohol copolymers, wherein the polyvinyl alcohol copolymers are optionally selected from sulphonated and carboxylated anionic polyvinylalcohol copolymers optionally carboxylated anionic polyvinylalcohol copolymers, optionally a blend of a polyvinylalcohol homopolymer and a carboxylated anionic polyvinylalcohol copolymer or blend of polyvinyl alcohol homopolymers. Optionally, the water-soluble film can comprise a polymer wherein the polymer can comprise a homopolymer, copolymer, or mixture thereof selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, xanthum, carragum or a mixture thereof, optionally, polyvinylalcohol homopolymers and/or anionic polyvinylalcohol copolymers optionally selected from sulphonated and carboxylated anionic polyvinylalcohol copolymers especially carboxylated anionic polyvinylalcohol copolymers. The films can be those supplied by Monosol, a Kuraray Division, Merrillville, Indiana, United States of America, under the trade references M8630, M8900, M8779, M8310. The film can be opaque, transparent or translucent. The film can comprise a printed area. The area of print may be achieved using standard techniques, such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. A suitable level includes, but is not limited to, 1 to 5000 ppm.

The water-soluble film or water-soluble unit dose article 2 or both may be coated with a lubricating agent. Optionally, the lubricating agent can be selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

Optionally, the detergent composition is a perfumed detergent composition. Perfumed detergent composition includes perfume added to the detergent composition. By unencapsulated perfume we herein mean perfume compounds are added directly to the detergent composition and are not present on encapsulates or on carrier materials. The composition might also comprise secondary perfume sources such as perfume capsule and/or pro-perfume e.g. perfume bound to a carrier material technology. The unencapsulated perfume can be formulated to be in a liquid laundry detergent composition to be provided in a water soluble unit dose article. The detergent composition can comprise between 0.01 and 10% of unencapsulated perfume. In addition to unencapsulated perfume, the detergent composition might also comprise encapsulated perfumes or pro-perfume technologies, or a mixture thereof.

The laundry detergent composition can comprise a non-soap surfactant, wherein the non-soap surfactant comprises an anionic non-soap surfactant and a non-ionic surfactant. Optionally, the laundry detergent composition can comprise between 10% and 60% by weight of the laundry detergent composition of the non-soap surfactant. The weight ratio of non-soap anionic surfactant to nonionic surfactant can be from 1:1 to 20:1. The non-soap anionic surfactant can comprise linear alkylbenzene sulphonate, alkyl sulphate or a mixture thereof. The weight ratio of linear alkylbenzene sulphonate to alkyl sulphate can be from 1:2 to 9:1. Exemplary linear alkylbenzene sulphonates are $C_{10}$-$C_{16}$ alkyl benzene sulfonic acids, or $C_{11}$-$C_{14}$ alkyl benzene sulfonic acids. By 'linear', it is meant that the alkyl group is linear. The alkyl sulphate anionic surfactant may comprise alkoxylated alkyl sulphate or non-alkoxylated alkyl sulphate or a mixture thereof. The alkoxylated alkyl sulphate anionic surfactant optionally is an ethoxylated alkyl sulphate anionic surfactant. The alkyl sulphate anionic surfactant may comprise an ethoxylated alkyl sulphate anionic surfactant, optionally having a mol average degree of ethoxylation from 1 to 5. The alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5. The alkyl fraction of the alkyl sulphate anionic surfactant can optionally be derived from fatty alcohols, oxo-synthesized alcohols, Guerbet alcohols, or mixtures thereof. Optionally, the non-ionic surfactant can be selected from alcohol alkoxylate, an oxo-synthesized alcohol alkoxylate, Guerbet alcohol alkoxylates, alkyl phenol alcohol alkoxylates, or a mixture thereof.

The laundry detergent composition can comprise between 0.01% and 10% by weight of the liquid laundry detergent composition of a non-ionic surfactant.

Optionally, the laundry detergent composition can comprise between 1.5% and 20% by weight of the laundry detergent composition of soap, optionally a fatty acid salt, optionally an amine neutralized fatty acid salt, wherein optionally the amine is an alkanolamine optionally selected from monoethanolamine, diethanolamine, triethanolamine or a mixture thereof, more optionally monoethanolamine.

Optionally, the laundry detergent composition is a liquid laundry detergent composition, optionally the liquid laundry detergent composition comprises less than 15% by weight of the liquid laundry detergent composition of water.

Optionally, the laundry detergent composition is a liquid laundry detergent composition that can comprise a non-aqueous solvent selected from 1,2-propanediol, dipropylene glycol, tripropyleneglycol, glycerol, sorbitol, polyethylene glycol or a mixture thereof. Optionally, the liquid laundry detergent composition can comprise between 10% and 40% by weight of the liquid laundry detergent composition of the non-aqueous solvent.

Optionally, the laundry detergent composition comprises an adjunct ingredient selected from builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof.

Optionally, the laundry detergent composition has a pH between 6 and 10, wherein the pH of the laundry detergent composition is measured as a 10% product concentration in demineralized water at 20° C. When liquid, the laundry detergent composition may be Newtonian or non-Newtonian. Optionally, the liquid laundry detergent composition is non-Newtonian.

Combinations

An Example is below:

A. A bag (10) comprising:

a first side sheet (20) having a pair of first side sheet transverse edges (70) and a first side sheet interior facing surface (23), wherein said first side sheet comprises an exteriorly oriented first pivotable flange (22) that is distal to a first folded portion (26) of said first side sheet and said first folded portion comprises a plurality of first panels (28) in which said first side sheet interior facing surface of said first panels are bonded to one another;

a second side sheet (30) opposite said first side sheet and having a second side sheet interior facing surface (33) facing said first side sheet interior facing surface, wherein said second side sheet is connected with said first side sheet across a bottom (60) of said bag and has a pair of second side sheet transverse edges (100), wherein each said first side sheet transverse edge is joined to an opposing second side sheet transverse edge, wherein said second side sheet comprises an interiorly oriented second pivotable flange (32) that is distal to a second folded portion (36) of said second side sheet and said second folded portion comprises a plurality of second panels (38) in which said second side sheet interior facing surface of said second panels are bonded to one another; and a repositionable pressure sensitive adhesive (150) that releasably engages said first pivotable flange and said second pivotable flange;

wherein said first side sheet and said second side sheet are each more than 80% by weight paper.

B. The bag according to Paragraph A, wherein said first folded portion is a z-fold (11).

C. The bag according to Paragraph A, wherein said first folded portion is an accordion fold (12).

D. The bag according to Paragraph C, wherein a penultimate first panel (120) of said first folded portion away from said first pivotable flange comprises apertures (110).

E. The bag according to Paragraph D, wherein an antepenultimate first panel (121) away from said first pivotable flange comprises apertures (110) aligned with said apertures of said penultimate first panel.

F. The bag according to any of Paragraphs A to E, wherein said second folded portion is an accordion fold (12).

G. The bag according to Paragraph F, wherein a penultimate second panel (220) away from said second pivotable flange comprises apertures (110).

H. The bag according to Paragraph G, wherein an antepenultimate second panel (221) away from said second pivotable flange comprises apertures (110) aligned with said apertures of said penultimate second panel.

I. The bag according to any of Paragraphs A to H, wherein said first side sheet interior facing surface and said second side sheet interior facing surface are coated with a thermoplastic material.

J. The bag according to Paragraph I, wherein said thermoplastic material is selected from low density polyethylene, linear low density polyethylene, high density polyethylene, polypropylene, polyacrylamide, linear polyacrylamide, styrene butadiene copolymer, and mixtures thereof.

K. The bag according to any of Paragraphs A to J, wherein said first side sheet interior facing surface and said second side sheet interior facing surface are covered with a thermoplastic film.

L. The bag according to Paragraph K, wherein said thermoplastic film is selected from low density polyethylene, linear low density polyethylene, high density polyethylene, polypropylene, polyacrylamide, linear polyacrylamide, styrene butadiene copolymer, and mixtures thereof.

M. The bag according to any of Paragraphs A to L, wherein said pressure sensitive adhesive has a load at failure according to ASTM D3165-07(2014) from 0.05 to 0.5 MPa and an average T-peel strength according to ASTM D903-98(2017) from 0.01 to 0.6 N/mm.

N. The bag according to any of Paragraphs A to M, wherein said pressure sensitive adhesive includes at least one material selected from acrylic and methacrylic ester homo or copolymers, butyl rubber based systems, silicones, nitriles, styrene block copolymers, ethylene vinyl acetate, urethanes, vinyl esters and amides, olefin copolymer materials, natural or synthetic rubber, and the mixtures thereof.

0. The bag according to any of Paragraphs A to N, wherein said pressure sensitive adhesive is on a surface selected from the group of said first pivotable flange, said second pivotable flange, and combinations thereof.

P. The bag according to any of Paragraphs A to O, wherein a free portion (160) that is an extension of said first pivotable flange projects exteriorly beyond said pressure sensitive adhesive.

Q. The bag according to any of Paragraphs A to P, wherein a free portion (160) that is an extension of said first pivotable flange projects exteriorly beyond said pressure sensitive adhesive and extends from one said first side sheet transverse edge to the other said first side sheet transverse edge.

R. The bag according to any of Paragraphs A to Q, wherein a free portion (160) that is an extension of said first pivotable flange projects exteriorly beyond said pressure sensitive adhesive, wherein said free portion is a tab (24).

S. The bag according to Paragraph R, wherein said tab contrasts in color from said first pivotable flange.

T. The bag according to any of Paragraphs A to S, wherein said bag comprises opposing top edges defined by fold lines in said first folded portion and said second folded portion and said first pivotable flange is recessed relative to said fold lines.

U. The bag according to any of Paragraphs A to T, wherein said bag contains a plurality of water-soluble unit dose articles (2).

V. The bag according to any of Paragraphs A to U, wherein said first pivotable flange is releasably engaged with said second pivotable flange by said pressure sensitive adhesive over a release zone having a release area, wherein said bag contains a cumulative weight of articles, wherein said pressure sensitive adhesive has a load at failure according to ASTM D3165-07(2014), wherein said load at failure according to ASTM D3165-07(2014) multiplied by said release area is from about 2 to about 500 times, optionally from about 5 to about 300 times, optionally from about 5 to about 100 times, greater than said cumulative weight of said articles.

W. The bag according to any of Paragraphs A to V, wherein said first pivotable flange is releasably engaged with said second pivotable flange by said pressure sensitive adhesive over a release zone having a release area, wherein said bag contains a cumulative weight of articles, wherein said release area and said cumulative weight of articles are provided at a ratio of from about 125 $mm^2$ per 100 g to about 1250 $mm^2$ per 100 g.

X. The bag according to any of Paragraphs A to W, wherein said second side sheet is continuous with said first side sheet across said bottom of said bag.

Y. The bag according to any of Paragraphs A to X, wherein said repositionable pressure sensitive adhesive extends along a longitudinal axis (L), wherein a penultimate first panel (120) of said first folded portion away from said first pivotable flange has a height orthogonal to said longitudinal axis, wherein said first pivotable flange has a terminal end and said terminal end is recessed relative to an outer fold line of said penultimate first panel by a distance ranging from about 30% to about 95% of said height.

Z. A method of opening the bag according to Paragraphs A to Y comprising the steps of:

grasping said second folded portion with one hand;

grasping said first pivotable flange; and peeling said first pivotable flange and said second folded portion away from one another to peel said first pivotable flange from said second pivotable flange along said pressure sensitive adhesive to open said bag; and optionally reengaging said first pivotable flange and said second pivotable flange with one another along said pressure sensitive adhesive to close said bag.

AA. A bag (10) comprising:

a first side sheet (20) having a pair of first side sheet transverse edges (70) and a first side sheet interior facing surface (23), wherein said first side sheet comprises an exteriorly oriented first pivotable flange (22) that is a distal end of a first folded portion (26) of said first side sheet and said first folded portion comprises a plurality of first panels (28) in which said first side sheet interior facing surface of said first panels are bonded to one another;

a second side sheet (30) opposite said first side sheet and having a second side sheet interior facing surface (33) facing said first side sheet interior facing surface, wherein said second side sheet is connected with said first side sheet across a bottom (60) of said bag and has a pair of second side sheet transverse edges (100), wherein each said first side sheet transverse edge is joined to an opposing second side sheet transverse edge, wherein said second side sheet comprises an interiorly oriented second pivotable flange (32) that is a distal end of a second folded portion (36) of said second side sheet and said second folded portion comprises a plurality of second panels (38) in which said second side sheet interior facing surface of said second panels are bonded to one another; and a repositionable pressure sensitive adhesive (150) that releasably engages said first pivotable flange and said second pivotable flange;

wherein said first side sheet and said second side sheet are each more than 80% by weight paper;

wherein said bag contains a cumulative weight of articles;

wherein said repositionable pressure sensitive adhesive has a load at failure according to ASTM D3165-07 (2014);

wherein said first pivotable flange is releasably engaged with said second pivotable flange by said repositionable pressure sensitive adhesive over a release zone having a release area, wherein said load at failure according to ASTM D3165-07(2014) multiplied by said release area is from about 2 to about 500 times greater than said cumulative weight of said articles.

BB. A bag (10) comprising:

a first side sheet (20) having a pair of first side sheet transverse edges (70) and a first side sheet interior facing surface (23), wherein said first side sheet comprises an exteriorly oriented first pivotable flange (22) that is distal to a first folded portion (26) of said first side sheet and said first folded portion comprises a plurality of first panels (28) in which said first side sheet interior facing surface of said first panels are bonded to one another;

a second side sheet (30) opposite said first side sheet and having a second side sheet interior facing surface (33) facing said first side sheet interior facing surface, wherein said second side sheet is connected with said first side sheet across a bottom (60) of said bag and has a pair of second side sheet transverse edges (100), wherein each said first side sheet transverse edge is joined to an opposing second side sheet transverse edge; and a repositionable pressure sensitive adhesive (150) that releasably engages said first pivotable flange and said second side sheet;

wherein said first side sheet and said second side sheet are each more than 80% by weight paper.

CC. The bag according to Paragraph BB, wherein said first folded portion is a z-fold (11).

DD. The bag according to Paragraph BB, wherein said first folded portion is an accordion fold (12).

EE. The bag according to Paragraph DD, wherein a penultimate first panel (120) of said first folded portion away from said first pivotable flange comprises apertures (110).

FF. The bag according to Paragraph EE, wherein an antepenultimate first panel (121) away from said first pivotable flange comprises apertures (110) aligned with said apertures of said penultimate first panel.

GG. The bag according to any of Paragraphs BB to FF, wherein said first side sheet interior facing surface and said second side sheet interior facing surface are coated with a thermoplastic material.

HH. The bag according to Paragraph GG, wherein said thermoplastic material is selected from low density polyethylene, linear low density polyethylene, high density polyethylene, polypropylene, polyacrylamide, linear polyacrylamide, styrene butadiene copolymer, and mixtures thereof.

II. The bag according to any of Paragraphs BB to FF, wherein said first side sheet interior facing surface and said second side sheet interior facing surface are covered with a thermoplastic film.

JJ. The bag according to Paragraph II, wherein said thermoplastic film is selected from low density polyethylene, linear low density polyethylene, high density polyethylene, polypropylene, polyacrylamide, linear polyacrylamide, styrene butadiene copolymer, and mixtures thereof.

KK. The bag according to any of Paragraphs BB to JJ, wherein said pressure sensitive adhesive has a load at failure according to ASTM D3165-07(2014) from 0.05 to 0.5 MPa and an average T-peel strength according to ASTM D903-98(2017) from 0.01 to 0.6 N/mm.

LL. The bag according to any of Paragraphs BB to KK, wherein said pressure sensitive adhesive includes at least one material selected from acrylic and methacrylic ester homo or copolymers, butyl rubber based systems, silicones, nitriles, styrene block copolymers, ethylene vinyl acetate, urethanes, vinyl esters and amides, olefin copolymer materials, natural or synthetic rubber, and the mixtures thereof.

MM. The bag according to any of Paragraphs BB to LL, wherein said pressure sensitive adhesive is on a surface selected from the group of said first pivotable flange, said second side sheet, and combinations thereof.

NN. The bag according to any of Paragraphs BB to MM, wherein a free portion (160) that is an extension of said first pivotable flange projects exteriorly beyond said pressure sensitive adhesive.

OO. The bag according to any of Paragraphs BB to NN, wherein a free portion (160) that is an extension of said first pivotable flange projects exteriorly beyond said pressure sensitive adhesive and extends from one said first side sheet transverse edge to the other said first side sheet transverse edge.

PP. The bag according to any of Paragraphs BB to OO, wherein a free portion (160) that is an extension of said first pivotable flange projects exteriorly beyond said pressure sensitive adhesive, wherein said free portion is a tab (24).

QQ. The bag according to Paragraph PP, wherein said tab contrasts in color from said first pivotable flange.

RR. The bag according to any of Paragraphs BB to QQ, wherein said bag contains a plurality of water-soluble unit dose articles (2).

SS. The bag according to any of Paragraphs BB to RR, wherein said first pivotable flange is releasably engaged with said second side sheet by said pressure sensitive adhesive over a release zone having a release area, wherein said bag contains a cumulative weight of articles, wherein said pressure sensitive adhesive has a load at failure according to ASTM D3165-07(2014), wherein said load at failure according to ASTM D3165-07(2014) multiplied by said release area is from about 2 to about 500 times, optionally from about 5 to about 300 times, optionally from about 5 to about 100 times, greater than said cumulative weight of said articles.

TT. The bag according to any of Paragraphs BB to RR, wherein said first pivotable flange is releasably engaged with said second side sheet by said pressure sensitive adhesive over a release zone having a release area, wherein said bag contains a cumulative weight of articles, wherein said release area and said cumulative weight of articles are provided at a ratio of from about 125 $mm^2$ per 100 g to about 1250 $mm^2$ per 100 g.

UU. The bag according to any of Paragraphs BB to TT, wherein said second side sheet is continuous with said first side sheet across said bottom of said bag.

VV. The bag according to any of Paragraphs BB to UU, wherein said repositionable pressure sensitive adhesive extends along a longitudinal axis (L), wherein a penultimate first panel (120) of said first folded portion away from said first pivotable flange has a height orthogonal to said longitudinal axis, wherein said first pivotable flange has a terminal end and said terminal end is recessed relative to an outer fold line of said penultimate first panel by a distance ranging from about 30% to about 95% of said height.

WW. A method of opening the bag according to Paragraphs BB to VV comprising the steps of:

grasping said second side sheet with one hand;

grasping said first pivotable flange; and peeling said first pivotable flange and said second side sheet away from one another to peel said first pivotable flange from said second side sheet along said pressure sensitive adhesive to open said bag; and optionally reengaging said first pivotable flange and said second side sheet with one another along said pressure sensitive adhesive to close said bag.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A bag comprising:

a first side sheet (20) having a pair of first side sheet transverse edges (70) and a first side sheet interior facing surface (23), wherein said first side sheet comprises an exteriorly oriented first pivotable flange (22) that is distal to a first folded portion (26) of said first side sheet and said first folded portion comprises a plurality of first panels (28) in which said first side sheet interior facing surface of said first panels are bonded to one another;

a second side sheet (30) opposite said first side sheet and having a second side sheet interior facing surface (33) facing said first side sheet interior facing surface, wherein said second side sheet is connected with said first side sheet across a bottom (60) of said bag and has a pair of second side sheet transverse edges (100), wherein each said first side sheet transverse edge is joined to an opposing second side sheet transverse edge, wherein said second side sheet comprises an interiorly oriented second pivotable flange (32) that is distal to a second folded portion (36) of said second side sheet and said second folded portion comprises a plurality of second panels (38) in which said second side sheet interior facing surface of said second panels are bonded to one another; and a repositionable pressure sensitive adhesive (150) that releasably engages said first pivotable flange and said second pivotable flange;

wherein said first side sheet and said second side sheet are each more than 80% by weight paper.

2. The bag according to claim 1, wherein said first folded portion is a z-fold (11).

3. The bag according to claim 1, wherein said first folded portion is an accordion fold (12).

4. The bag according to claim 3, wherein a penultimate first panel (120) of said first folded portion away from said first pivotable flange comprises apertures (110).

5. The bag according to claim 4, wherein an antepenultimate first panel (121) away from said first pivotable flange comprises apertures (110) aligned with said apertures of said penultimate first panel.

6. The bag according to claim 5, wherein said second folded portion is an accordion fold (12).

7. The bag according to claim 6, wherein a penultimate second panel (220) away from said second pivotable flange comprises apertures (110).

8. The bag according to claim 7, wherein an antepenultimate second panel (221) away from said second pivotable flange comprises apertures (110) aligned with said apertures of said penultimate second panel.

9. The bag according to claim 1, wherein said first side sheet interior facing surface and said second side sheet interior facing surface are coated with a thermoplastic material.

10. The bag according to claim 9, wherein said thermoplastic material is selected from low density polyethylene, linear low density polyethylene, high density polyethylene, polypropylene, polyacrylamide, linear polyacrylamide, styrene butadiene copolymer, and mixtures thereof.

11. The bag according to claim 1, wherein said first side sheet interior facing surface and said second side sheet interior facing surface are covered with a thermoplastic film.

12. The bag according to claim 11, wherein said thermoplastic film is selected from low density polyethylene, linear low density polyethylene, high density polyethylene, polypropylene, polyacrylamide, linear polyacrylamide, styrene butadiene copolymer, and mixtures thereof.

13. The bag according to claim 1, wherein said pressure sensitive adhesive has a load at failure according to ASTM D3165-07(2014) from 0.05 to 0.5 MPa and an average T-peel strength according to ASTM D903-98(2017) from 0.01 to 0.6 N/mm.

14. The bag according to claim 1, wherein a free portion (160) that is an extension of said first pivotable flange projects exteriorly beyond said pressure sensitive adhesive.

15. The bag according to claim 1, wherein said bag comprises opposing top edges defined by fold lines in said first folded portion and said second folded portion and said first pivotable flange is recessed relative to said fold lines.

16. The bag according to claim 1, wherein said first pivotable flange is releasably engaged with said second pivotable flange by said pressure sensitive adhesive over a release zone having a release area, wherein said bag contains a cumulative weight of articles, wherein said pressure sensitive adhesive has a load at failure according to ASTM D3165-07(2014), wherein said load at failure according to ASTM D3165-07(2014) multiplied by said release area is from about 2 to about 500 times greater than said cumulative weight of said articles.

17. The bag according to claim 1, wherein said repositionable pressure sensitive adhesive extends along a longitudinal axis (L), wherein a penultimate first panel (120) of said first folded portion away from said first pivotable flange has a height orthogonal to said longitudinal axis, wherein said first pivotable flange has a terminal end and said terminal end is recessed relative to an outer fold line of said penultimate first panel by a distance ranging from about 30% to about 95% of said height.

18. A method of opening the bag according to claim 1 comprising the steps of:

grasping said second folded portion with one hand;

grasping said first pivotable flange; and peeling said first pivotable flange and said second folded portion away from one another to peel said first pivotable flange from said second pivotable flange along said pressure sensitive adhesive to open said bag.

19. A bag comprising:

a first side sheet (20) having a pair of first side sheet transverse edges (70) and a first side sheet interior facing surface (23), wherein said first side sheet comprises an exteriorly oriented first pivotable flange (22) that is distal to a first folded portion (26) of said first side sheet and said first folded portion comprises a plurality of first panels (28) in which said first side sheet interior facing surface of said first panels are bonded to one another;

a second side sheet (30) opposite said first side sheet and having a second side sheet interior facing surface (33) facing said first side sheet interior facing surface, wherein said second side sheet is connected with said first side sheet across a bottom (60) of said bag and has a pair of second side sheet transverse edges (100), wherein each said first side sheet transverse edge is joined to an opposing second side sheet transverse edge, wherein said second side sheet comprises an interiorly oriented second pivotable flange (32) that is distal to a second folded portion (36) of said second side sheet and said second folded portion comprises a plurality of second panels (38) in which said second side sheet interior facing surface of said second panels are bonded to one another; and a repositionable pressure sensitive adhesive (150) that releasably engages said first pivotable flange and said second pivotable flange;

wherein said first side sheet and said second side sheet are each more than 80% by weight paper;

wherein said bag contains a cumulative weight of articles;

wherein said repositionable pressure sensitive adhesive has a load at failure according to ASTM D3165-07 (2014);

wherein said first pivotable flange is releasably engaged with said second pivotable flange by said repositionable pressure sensitive adhesive over a release zone having a release area, wherein said load at failure according to ASTM D3165-07(2014) multiplied by said release area is from about 2 to about 500 times greater than said cumulative weight of said articles.

20. A method of opening the bag according to claim 1 comprising the steps of:

grasping said second folded portion with one hand;

grasping said first pivotable flange; and peeling said first pivotable flange and said second folded portion away from one another to peel said first pivotable flange from said second pivotable flange along said pressure sensitive adhesive to open said bag; and reengaging said first pivotable flange and said second pivotable flange with one another along said pressure sensitive adhesive to close said bag.

* * * * *